US010168660B2

(12) United States Patent
Shimizu

(10) Patent No.: US 10,168,660 B2
(45) Date of Patent: Jan. 1, 2019

(54) DEVELOPING CARTRIDGE INCLUDING FIRST GEAR AND SECOND GEAR

(71) Applicant: BROTHER KOGYO KABUSHIKI KAISHA, Nagoya-shi, Aichi-ken (JP)

(72) Inventor: Keita Shimizu, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/719,676

(22) Filed: Sep. 29, 2017

(65) Prior Publication Data

US 2018/0284689 A1 Oct. 4, 2018

(30) Foreign Application Priority Data

Mar. 30, 2017 (JP) ..... 2017-067694

(51) Int. Cl.
*G03G 21/16* (2006.01)
*G03G 21/18* (2006.01)

(52) U.S. Cl.
CPC ..... *G03G 21/1647* (2013.01); *G03G 21/1676* (2013.01); *G03G 21/1896* (2013.01)

(58) Field of Classification Search
CPC ..... G03G 15/0831; G03G 15/0832; G03G 15/55; G03G 21/1647; G03G 21/1676; G03G 21/1875; G03G 21/1892; G03G 21/1896; G03G 2221/163; G03G 2221/1892
See application file for complete search history.

(56) References Cited

U.S. PATENT DOCUMENTS 8,494,380 B2 7/2013 Carot
2007/0122165 A1 5/2007 Igarashi et al.
2011/0236062 A1 9/2011 Takagi
(Continued)

FOREIGN PATENT DOCUMENTS

EP 2 765 459 A1 8/2014
JP 54-22230 A 2/1979
(Continued)

OTHER PUBLICATIONS

Extended European Search Report issued in corresponding European Patent Application 17193952.3, dated Feb. 22, 2018.
(Continued)

*Primary Examiner* — Sophia S Chen
(74) *Attorney, Agent, or Firm* — Merchant & Gould P.C.

(57) ABSTRACT

A developing cartridge includes a lever, an urging member, a first gear, a second gear, and a protrusion rotatable together therewith. The lever is movable between a first position and a second position. The urging member urges the lever toward the first position. The first gear includes first and second gear portions. The second gear portion has an addendum circle greater than that of the first gear portion. The second gear includes a third gear portion engageable with the first gear portion and a fourth gear portion engageable with the second gear portion. The fourth gear portion has an addendum circle smaller than that of the third gear portion. In a case where the second gear rotates while engaging with the fourth gear portion, the protrusion contacts the lever to move the lever from the first position to the second position against urging force of the urging member.

30 Claims, 15 Drawing Sheets

(56) References Cited

U.S. PATENT DOCUMENTS

| | | | | |
|---|---|---|---|---|
| 2014/0086613 | A1 | 3/2014 | Itabashi et al. | |
| 2015/0117906 | A1* | 4/2015 | Mori | G03G 21/1647 399/254 |
| 2015/0277353 | A1 | 10/2015 | Fukamachi | |
| 2017/0097607 | A1* | 4/2017 | Watanabe | G03G 21/1647 |
| 2017/0123346 | A1 | 5/2017 | Shimizu et al. | |
| 2017/0123347 | A1* | 5/2017 | Shimizu | G03G 21/1647 |
| 2018/0017893 | A1* | 1/2018 | Shimizu | G03G 21/1896 |

FOREIGN PATENT DOCUMENTS

| | | | |
|---|---|---|---|
| JP | 10-63164 | A | 3/1998 |
| JP | 2011-203362 | A | 10/2011 |
| JP | 2012-194318 | A | 10/2012 |
| JP | 2016-194718 | A | 11/2016 |
| JP | 2017-68217 | A | 4/2017 |
| WO | 2017-056336 | A1 | 4/2017 |

OTHER PUBLICATIONS

International Search Report and Written Opinion issued in corresponding International Patent Application No. PCT/JP2017/035590, dated Nov. 28, 2017.

* cited by examiner

DEVELOPING CARTRIDGE INCLUDING FIRST GEAR AND SECOND GEAR

CROSS REFERENCE TO RELATED APPLICATION

This application claims priority from Japanese Patent Application No. 2017-067694 filed Mar. 30, 2017. The entire content of the priority application is incorporated herein by reference.

TECHNICAL FIELD

The present disclosure relates to a developing cartridge used for an image forming apparatus.

BACKGROUND

There have been known image forming apparatuses including developing cartridges. One of such image forming apparatuses is configured to identify the specification of the developing cartridge or determine whether or not the developing cartridge is attached. For example, a prior art discloses a developing cartridge including a detection gear and protrusions moving together with rotation of the detection gear. In this configuration, an image forming apparatus senses the protrusions by means of a sensor to detect whether the developing cartridge is attached.

SUMMARY

In a case where the image forming apparatus is configured to identify the specification of the developing cartridge by detecting the protrusions thereof, the arrangement patterns of the protrusions are made different for each of a plurality of specifications. This enables the image forming apparatus to identify a developing cartridge having a specific specification from among the plurality of specifications.

In recent years, there is a demand to diversify motions of gear structures of the developing cartridges in response to diversification of the specifications of the developing cartridges. It is therefore an object of the disclosure to provide a developing cartridge in which motion of a gear structure can be diversified in response to diversification of the specifications of the developing cartridges.

In order to attain the above and other objects, according to one aspect, the disclosure provides a developing cartridge including a casing, a lever, a first urging member, a first gear, a second gear, and a first protrusion. The casing is configured to accommodate therein developing agent. The lever is movable relative to the casing between a first position and a second position, and is positioned at an outer surface of the casing. The first urging member is configured to urge the lever toward the first position. The first gear is rotatable about a first axis extending in a first direction, and is positioned at the outer surface of the casing. The first gear includes a first gear portion and a second gear portion. The first gear portion has an addendum circle. The second gear portion is positioned at a position different from a position of the first gear portion in the first direction. The second gear portion has an addendum circle greater than the addendum circle of the first gear portion. The second gear is rotatable about a second axis extending in the first direction, and is positioned at the outer surface. The second gear includes a third gear portion engageable with the first gear portion and a fourth gear portion engageable with the second gear portion. The third gear portion has an addendum circle. The fourth gear portion is positioned at a position different from a position of the third gear portion in the first direction. The fourth gear portion has an addendum circle smaller than the addendum circle of the third gear portion. The first protrusion is rotatable together with the second gear. In a case where the second gear rotates in a state where the second gear portion is in engagement with the fourth gear portion, the first protrusion contacts the lever to move the lever from the first position to the second position against urging force of the first urging member.

BRIEF DESCRIPTION OF THE DRAWINGS

The particular features and advantages of the disclosure will become apparent from the following description taken in connection with the accompanying drawings, in which.

DETAILED DESCRIPTION

A developing cartridge according to one embodiment of the present disclosure will be descried in detail with reference to the accompanying drawings.

First, a laser printer 1 to which a developing cartridge 10 as an example of the developing cartridge according to the embodiment is detachably attachable will be described.

Figure 1:
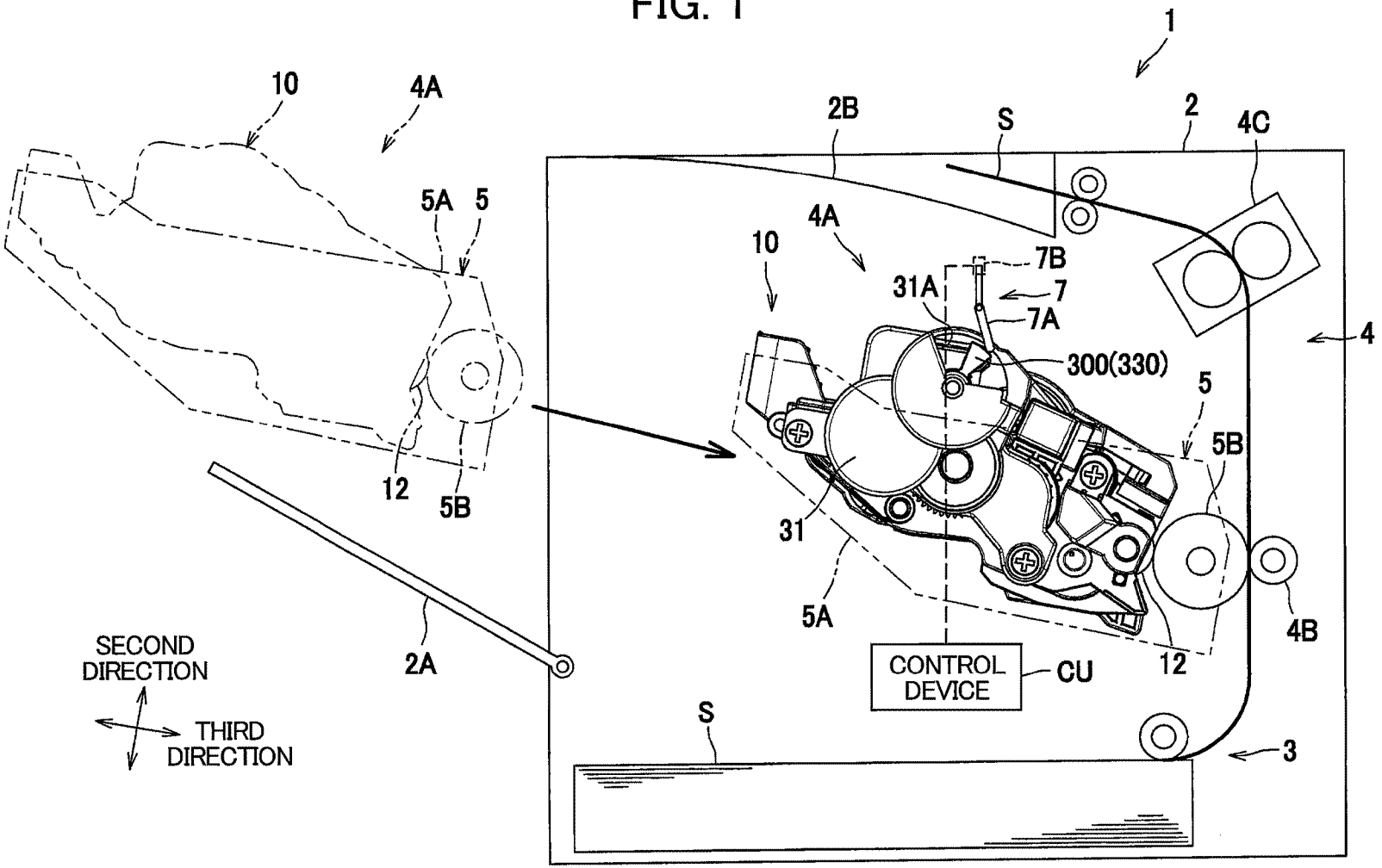
FIG. 1 is a schematic diagram illustrating a configuration of an image forming apparatus including a developing cartridge according to an embodiment of the present disclosure.

As illustrated in FIG. 1, the laser printer 1 as an example of an image forming apparatus mainly includes a main body housing 2, a sheet supply portion 3, an image forming portion 4, and a control device CU.

The main body housing 2 includes a front cover 2A and a sheet discharge tray 2B positioned at the upper portion of the main body housing 2. The main body housing 2 is internally provided with the sheet supply portion 3 and the image forming portion 4. In a state where the front cover 2A is opened, the developing cartridge 10 is detachably attached to the laser printer 1.

The sheet supply portion 3 accommodates sheets of paper S. The sheet supply portion 3 supplies the sheets S one by one to the image forming portion 4.

The image forming portion 4 includes a process cartridge 4A, an exposure device (not illustrated), a transfer roller 4B, and a fixing device 4C.

The process cartridge 4A includes a photosensitive cartridge 5, and the developing cartridge 10. The developing cartridge 10 is attachable to and detachable from the photosensitive cartridge 5. In a state where the developing cartridge 10 is attached to the photosensitive cartridge 5, the developing cartridge 10 is attached to and detached from, as the process cartridge 4A, the laser printer 1. The photosensitive cartridge 5 includes a frame 5A and a photosensitive drum 5B rotatably supported by the frame 5A.

Figure 2:
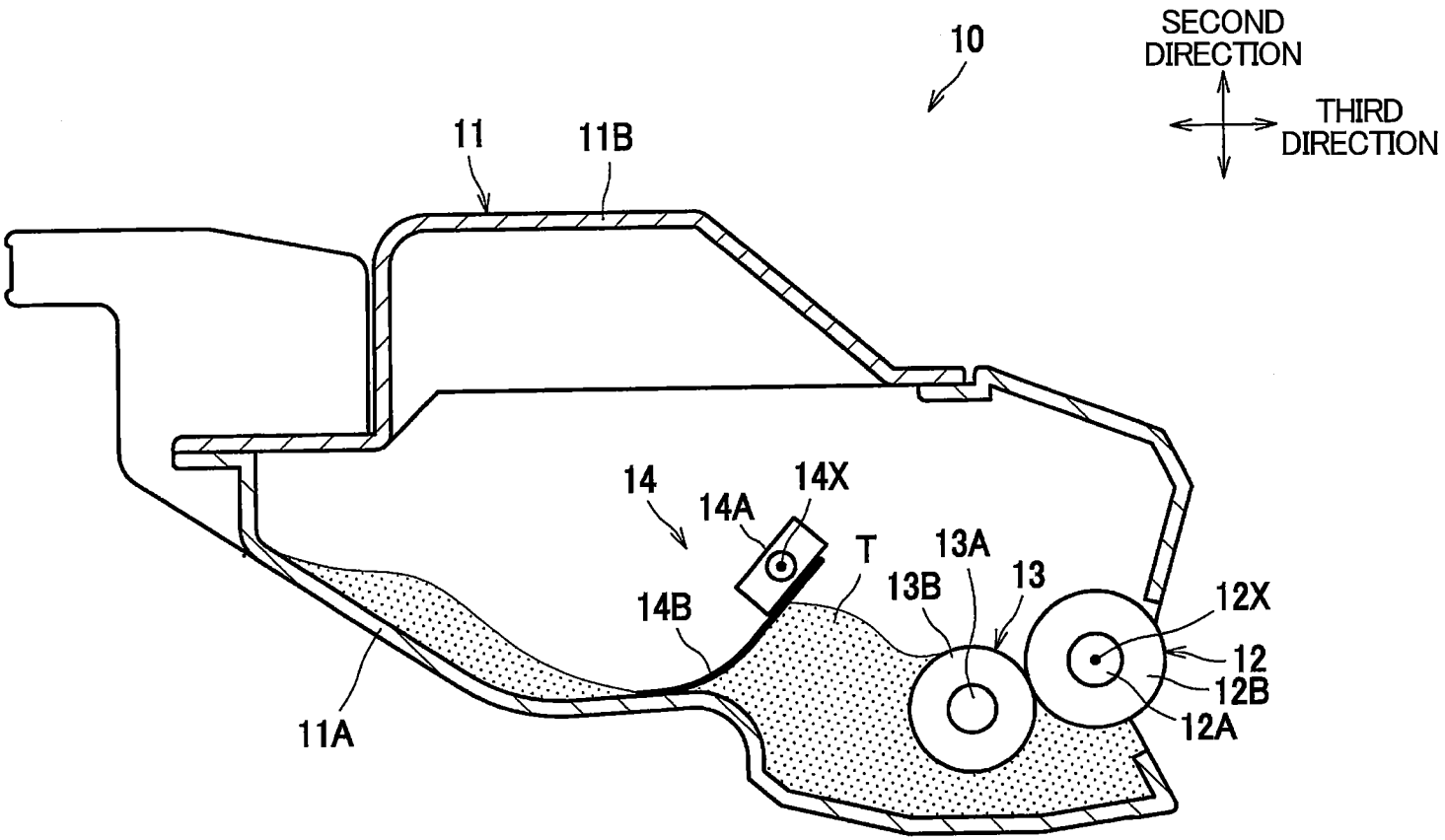
FIG. 2 is a cross-sectional view illustrating a configuration of the developing cartridge.

As illustrated in FIG. 2, the developing cartridge 10 includes a casing 11, a developing roller 12, a supply roller 13, and an agitator 14.

The casing 11 includes a container 11A and a lid 11B. The container 11A of the casing 11 is configured to accommodate therein toner T. The toner T is an example of developing agent.

The developing roller 12 includes a developing roller shaft 12A extending in a first direction and a roller portion 12B. The first direction is identical to an axial direction of an idle gear 100 (described later). Hereinafter, the first direction is also simply referred to as the axial direction. The roller portion 12B covers the outer circumferential surface of the developing roller shaft 12A. The roller portion 12B is made of, for example, electrically conductive rubber.

The developing roller 12 is rotatable about the developing roller shaft 12A. In other words, the developing roller 12 is rotatable about a fifth axis 12X extending in the first direction. The developing roller 12 is supported by the casing 11 so as to be rotatable about the developing roller shaft 12A. That is, the roller portion 12B of the developing roller 12 is rotatable together with the developing roller shaft 12A. The developing roller 12 is applied with a developing bias by the control device CU.

The container 11A and the lid 11B of the casing 11 face each other in a second direction. The second direction crosses the first direction. Preferably, the second direction is orthogonal to the first direction. The developing roller 12 is positioned at one end portion of the casing 11 in a third direction. The third direction crosses the first direction and the second direction. Preferably, the third direction is orthogonal to both the first direction and the second direction.

The supply roller 13 includes a supply roller shaft 13A extending in the first direction and a roller portion 13B. The roller portion 13B covers the outer circumferential surface of the supply roller shaft 13A. The roller portion 13B is made of, for example, sponge. The supply roller 13 is rotatable about the supply roller shaft 13A. That is, the roller portion 13B of the supply roller 13 is rotatable together with the supply roller shaft 13A.

The agitator 14 includes an agitator shaft 14A as an example of a shaft and a flexible sheet 14B. The agitator shaft 14A extends in the first direction. The agitator shaft 14A is rotatable about a third axis 14X extending in the first direction. The agitator shaft 14A is supported by the casing 11 so as to be rotatable about the third axis 14X. That is, the agitator 14 is rotatable about the third axis 14X. The agitator shaft 14A is rotatable in accordance with rotation of a coupling 22 (described later). The flexible sheet 14B has a base end fixed to the agitator shaft 14A and a leading end configured to contact the inner surface of the casing 11. The agitator 14 is configured to agitate the toner T by making use of the rotating flexible sheet 14B.

As illustrated in FIG. 1, the transfer roller 4B faces the photosensitive drum 5B. The transfer roller 4B conveys the sheet S while nipping the sheet S between the transfer roller 4B and the photosensitive drum 5B.

The photosensitive drum 5B is charged by a charger (not illustrated) and is exposed to light by the exposure device, whereby an electrostatic latent image is formed on the photosensitive drum 5B. The developing cartridge 10 supplies the toner T to the electrostatic latent image to form a toner image on the photosensitive drum 5B. The toner image formed on the photosensitive drum 5B is transferred onto the sheet S supplied from the sheet supply portion 3 while the sheet S passes through between the photosensitive drum 5B and the transfer roller 4B.

The fixing device 4C thermally fixes the toner image transferred to the sheet S to the sheet S. The sheet S to which the toner image has been thermally fixed is discharged onto the sheet discharge tray 2B outside the main body housing 2.

The control device CU is a device which controls the entire operation of the laser printer 1.

The laser printer 1 includes a sensor 7. The sensor 7 is configured to detect whether or not the developing cartridge 10 is a new cartridge, and further detects the specification of the developing cartridge 10. The sensor 7 includes a main body lever 7A and an optical sensor 7B.

The main body lever 7A is swingably supported by the main body housing 2. The main body lever 7A is positioned at a position where the main body lever 7A can contact a detection lever 300 described later.

The optical sensor 7B is connected to the control device CU and outputs a detection signal to the control device CU. The control device CU is configured to identify the specification and the like of the developing cartridge 10 on the basis of the detection signal received from the optical sensor 7B. The optical sensor 7B detects displacement of the main body lever 7A and transmits the detection signal to the control device CU. More specifically, for example, a sensor unit including a light-emitting portion and a light-receiving portion is employed as the optical sensor 7B. The details will be described later.

Figure 3:
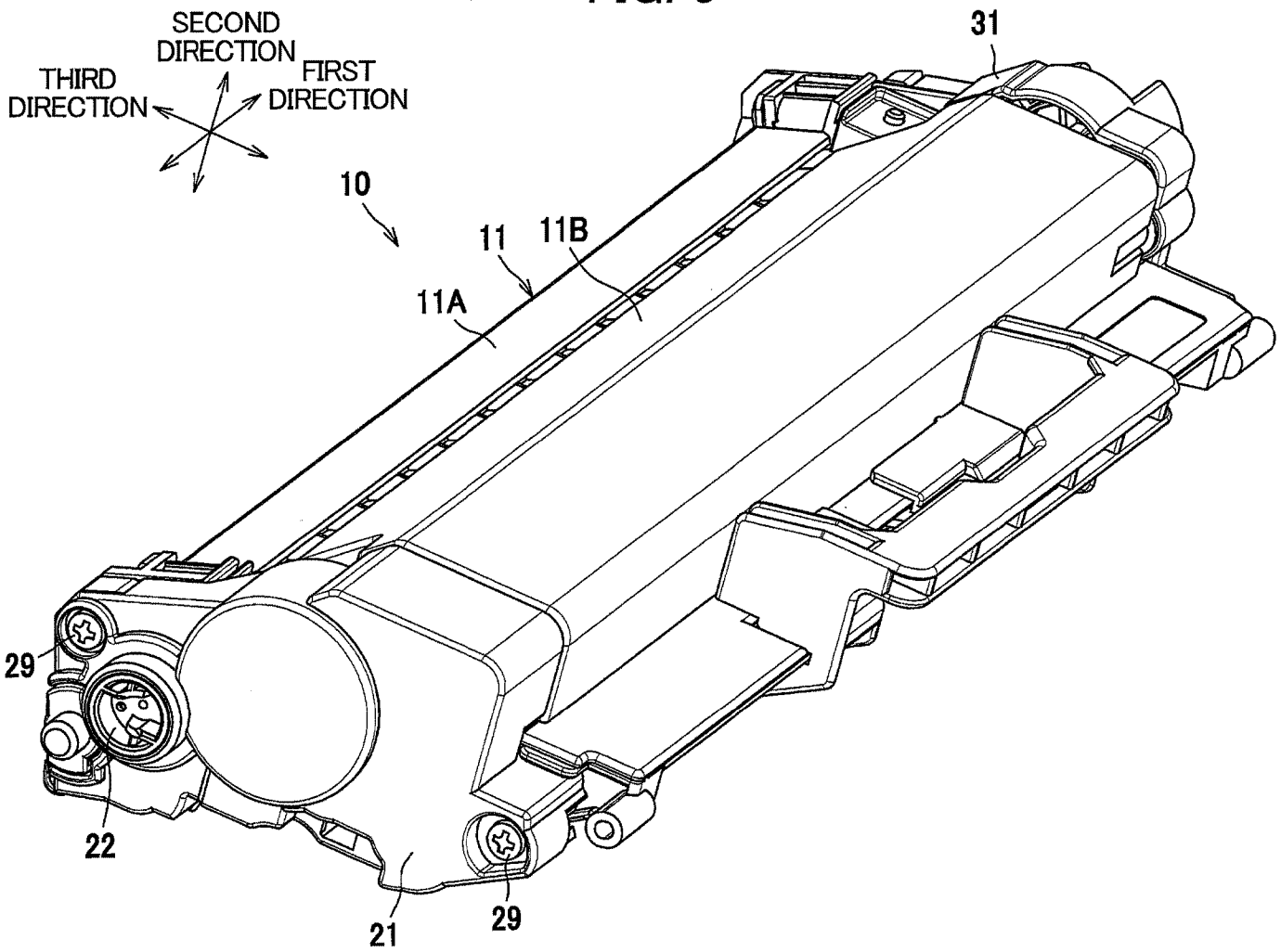
FIG. 3 is a perspective view illustrating one side in a first direction of the developing cartridge.
Figure 4:
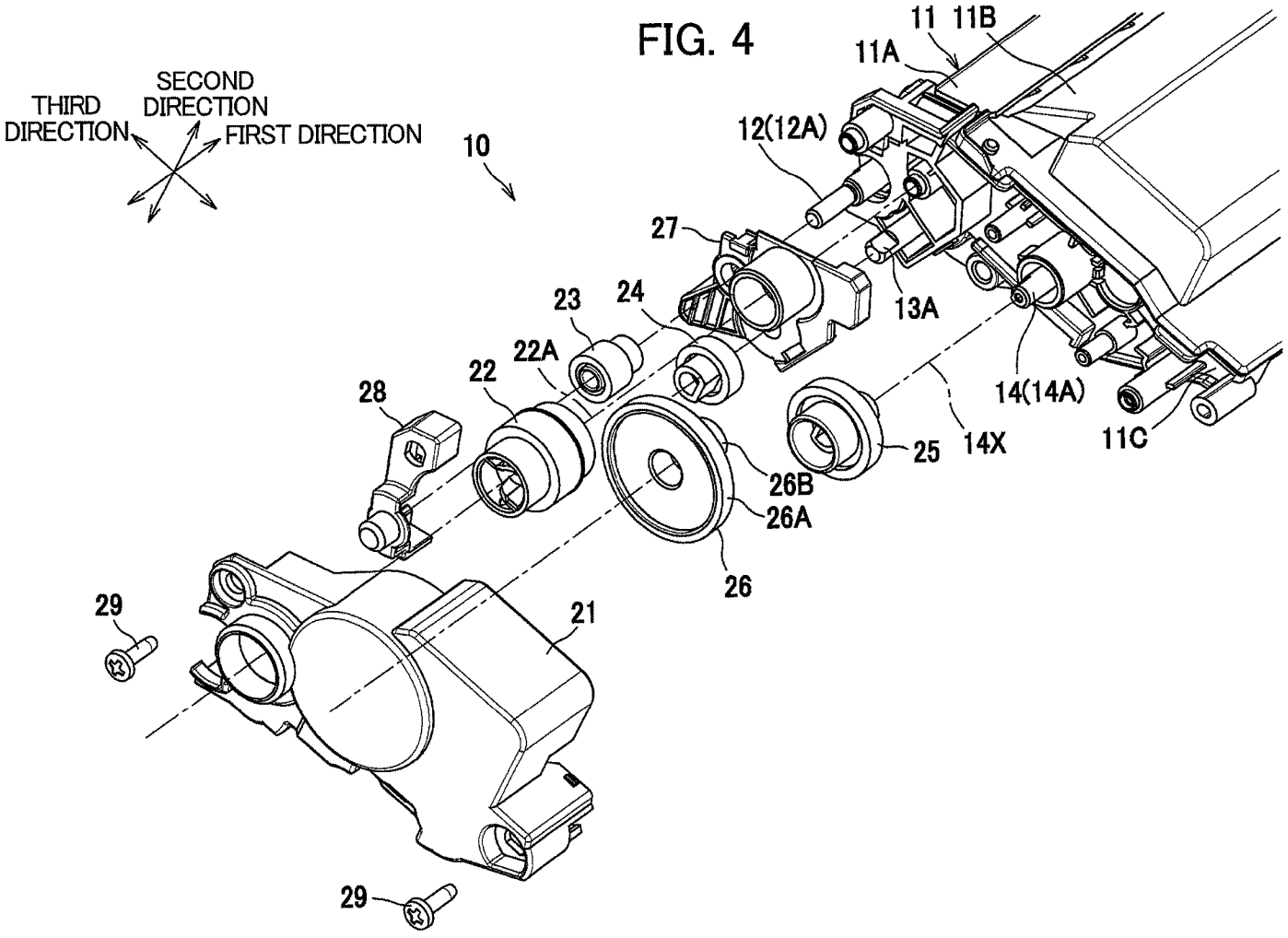
FIG. 4 is an exploded perspective view of parts positioned at one side in the first direction of a casing of the developing cartridge.

Next, the configuration of the developing cartridge 10 will be described in detail. As illustrated in FIGS. 3 and 4, the developing cartridge 10 includes a first gear cover 21, the coupling 22, a developing gear 23, a supply gear 24, a first agitator gear 25, an idle gear 26, a first bearing member 27, and a cap 28. The first gear cover 21, the coupling 22, the developing gear 23, the supply gear 24, the first agitator gear 25, the idle gear 26, the first bearing member 27, and the cap 28 are positioned at one side of the casing 11 in the first direction.

The first gear cover 21 includes a shaft (not illustrated) and supports the idle gear 26 at the shaft. The first gear cover 21 covers at least one of the gears positioned at the one side of the casing 11 in the first direction. The first gear cover 21 is fixed to an outer surface 11C with screws 29. The outer surface 11C is an outer surface positioned at the one side of the casing 11 in the first direction.

Note that, in the present specification, "gear" is not limited to a member which has gear teeth and transmits a rotational force through the gear teeth, but includes a member which transmits a rotational force by a friction transmission. Further, in the member which transmits the rotational force by the friction transmission, a circle along a friction transmitting surface (i.e., an outer circumferential surface which transmits the rotational force through friction) is defined as an addendum circle.

The coupling 22 is rotatable about a sixth axis 22A extending in the first direction. The coupling 22 is positioned at the one side of the casing 11 in the first direction. That is, the coupling 22 is positioned at the outer surface 11C. The coupling 22 is rotatable by receiving drive force. More specifically, the coupling 22 can receive drive force from the laser printer 1. The laser printer 1 includes a drive member (not illustrated), and the coupling 22 is rotatable by engaging with the drive member. The coupling 22 has a recessed portion which is recessed in the first direction. The recessed portion is configured to receive the drive member and to engage with the drive member. More specifically, engagement of the recessed portion with the drive member enables the recessed portion to receive drive force from the laser printer 1.

The developing gear 23 is mounted to the developing roller shaft 12A and is rotatable in accordance with rotation of the coupling 22. The developing gear 23 is positioned at the one side of the casing 11 in the first direction. That is, the developing gear 23 is positioned at the outer surface 11C.

The supply gear 24 is mounted to the supply roller shaft 13A and is rotatable in accordance with the rotation of the coupling 22. The supply gear 24 is positioned at the one side of the casing 11 in the first direction. That is, the supply gear 24 is positioned at the outer surface 11C.

The first agitator gear 25 is positioned at the one side of the casing 11 in the first direction. That is, the first agitator gear 25 is positioned at the outer surface 11C. The first agitator gear 25 is mounted to the agitator shaft 14A of the agitator 14 and is rotatable together with the agitator 14 in accordance with the rotation of the coupling 22.

The idle gear 26 is positioned at the one side of the casing 11 in the first direction. That is, the idle gear 26 is positioned at the outer surface 11C. The idle gear 26 includes a large diameter portion 26A in engagement with the gear teeth of the coupling 22 and a small diameter portion 26B in engagement with the gear teeth of the first agitator gear 25. The idle gear 26 is rotatably supported by the shaft (not illustrated) of the first gear cover 21. The idle gear 26 decelerates rotation of the coupling 22 and transmits the decelerated rotation to the first agitator gear 25. Incidentally, the large diameter portion 26A is positioned farther from the casing 11 in the first direction than the small diameter portion 26B is from the casing 11.

The first bearing member 27 axially supports the coupling 22, the developing gear 23, and the supply gear 24. The first bearing member 27 is fixed to the one side of the casing 11 in the first direction.

The cap 28 covers one end portion of the developing roller shaft 12A in the first direction. The first gear cover 21 and the cap 28 may be made of mutually different resins.

Figure 5:
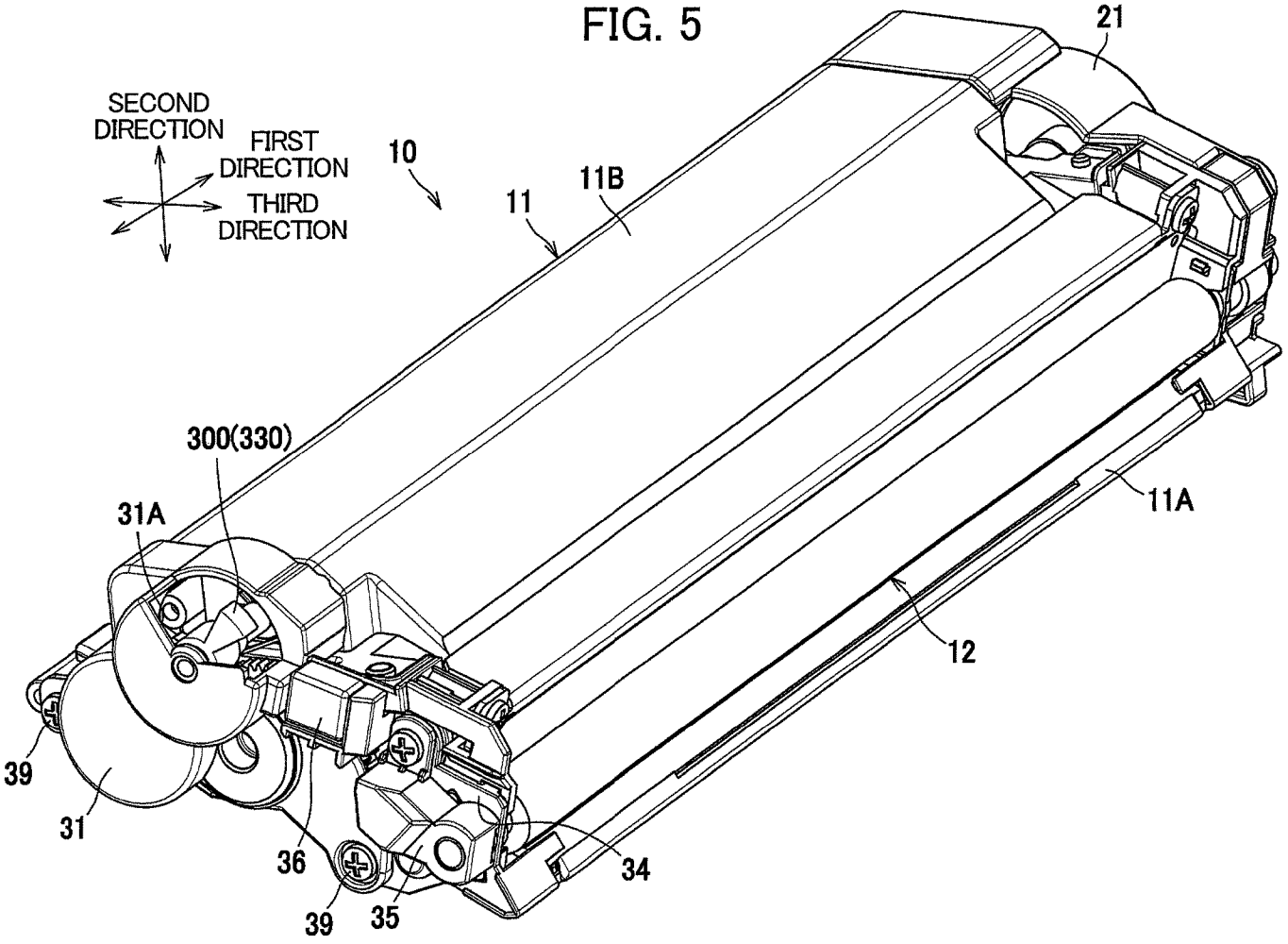
FIG. 5 is a perspective view illustrating another side in the first direction of the developing cartridge.
Figure 6:
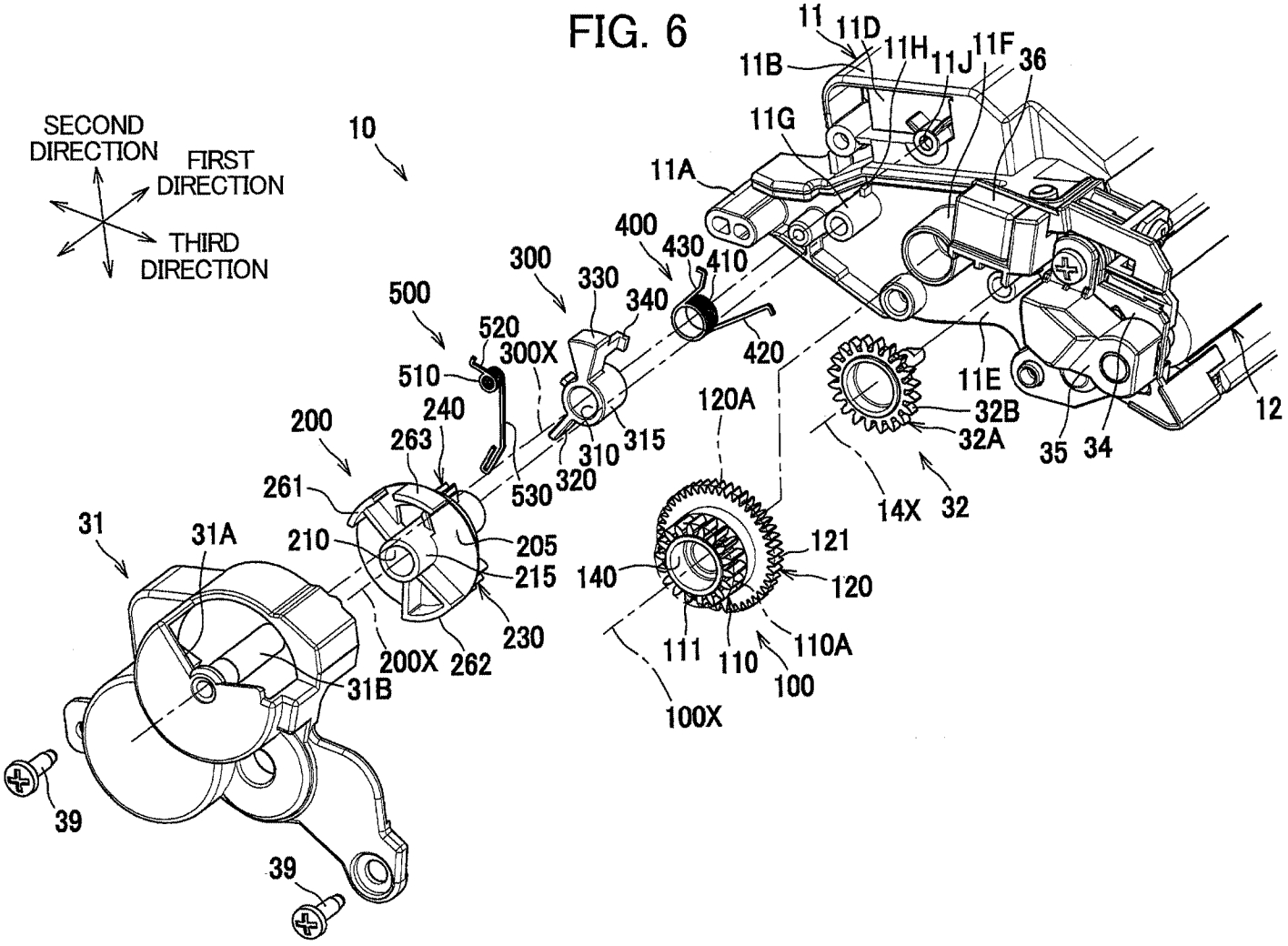
FIG. 6 is an exploded perspective view of parts of a gear structure positioned at another side in the first direction of the casing of the developing cartridge.

As illustrated in FIGS. 5 and 6, the developing cartridge 10 includes a second gear cover 31 as an example of a cover, a second agitator gear 32 as an example of an agitator gear, the idle gear 100 as an example of a first gear, a detection gear 200 as an example of a second gear, the detection lever 300 as an example of a lever, a torsion spring 400 as an example of a first urging member, a torsion spring 500 as an example of a second urging member, a second bearing member 34, a developing electrode 35, and a supply electrode 36. The second gear cover 31, the second agitator gear 32, the idle gear 100, the detection gear 200, the detection lever 300, the torsion spring 400, the torsion spring 500, the second bearing member 34, the developing electrode 35, and the supply electrode 36 are positioned at another side of the casing 11 in the first direction.

The second gear cover 31 covers at least a portion of the detection lever 300. The second gear cover 31 covers a portion of the detection lever 300, the second agitator gear 32, the idle gear 100, and the detection gear 200. The second gear cover 31 is positioned at an outer surface 11E, which is defined at another side in the first direction of the container 11A of the casing 11. The second gear cover 31 has an opening 31A. The second gear cover 31 includes a lever shaft 31B extending in the first direction. The second gear cover 31 is fixed to the outer surface 11E with screws 39.

At least a portion of the detection lever 300 is exposed through the opening 31A. More specifically, a lever contact portion 330 (described later) of the detection lever 300 is exposed through the opening 31A.

As illustrated in FIG. 6, the second agitator gear 32 is positioned at the other side of the casing 11 in the first direction. That is, the second agitator gear 32 is positioned at the outer surface 11E which is defined at the other side of the container 11A of the casing 11 in the first direction. The second agitator gear 32 is mounted to the agitator shaft 14A of the agitator 14. Thus, the second agitator gear 32 is rotatable about the third axis 14X together with the agitator shaft 14A of the agitator 14. That is, the second agitator gear 32 is rotatably supported by the casing 11. The second agitator gear 32 is rotatable in accordance with rotation of the coupling 22. The second agitator gear 32 is an example of a third gear.

The second agitator gear 32 includes a gear portion 32A. The gear portion 32A includes a plurality of gear teeth 32B. The gear portion 32A includes the gear teeth 32B provided over the entire circumferential periphery of the second agitator gear 32.

The idle gear 100 is positioned at the other side of the casing 11 in the first direction. That is, the idle gear 100 is positioned at the outer surface 11E which is defined at the other side of the container 11A of the casing 11 in the first direction. The idle gear 100 is rotatable about a first axis 100X extending in the axial direction. The idle gear 100 has a attaching hole 140. The casing 11 includes a shaft 11F protruding from the outer surface 11E and extending in the first direction. The idle gear 100 is mounted to the casing 11 by engaging the shaft 11F with the attaching hole 140. As a result, the idle gear 100 is rotatably supported by the casing 11.

The idle gear 100 includes a first gear portion 110 and a second gear portion 120. The first gear portion 110 includes a plurality of gear teeth 111. As an example, the first gear portion 110 includes the gear teeth 111 provided over the entire circumferential periphery of the idle gear 100. The gear teeth 111 of the first gear portion 110 of the idle gear 100 are in engagement with the gear teeth 32B of the gear portion 32A of the second agitator gear 32. Thus, the idle gear 100 is rotatable in accordance with rotation of the second agitator gear 32.

The second gear portion 120 includes a plurality of gear teeth 121. The plurality of gear teeth 121 is rotatable about the first axis 100X together with the first gear portion 110. As an example, the second gear portion 120 includes the gear teeth 121 provided over the entire circumferential periphery of the idle gear 100. The second gear portion 120 is positioned at a position different from a position of the first gear portion 110 in the axial direction (i.e., the first direction). Specifically, the second gear portion 120 is positioned closer to the casing 11 in the axial direction than the first gear portion 110 is to the casing 11. An addendum circle 120A of the second gear portion 120 is greater in diameter than an addendum circle 110A of the first gear portion 110.

The detection gear 200 is positioned at the other side of the casing 11 in the first direction. That is, the detection gear 200 is positioned at the outer surface 11E. The detection gear 200 is rotatable about a second axis 200X extending in the axial direction. The detection gear 200 is engageable with the idle gear 100 and thus is rotatable in accordance with rotation of the idle gear 100.

The detection gear 200 includes a tubular portion 215 having a hole 210. The casing 11 includes a shaft 11G protruding from the outer surface 11E and extending in the first direction. The casing 11 further includes a locking protrusion 11H protruding outward in the radial direction from the shaft 11G. Further, the locking protrusion 11H protrudes in the axial direction from the outer surface 11E of the casing 11. The shaft 11G is inserted into the hole 210, and thus the detection gear 200 is rotatable about the shaft 11G. That is, the detection gear 200 is rotatably supported by the casing 11.

Figure 7:
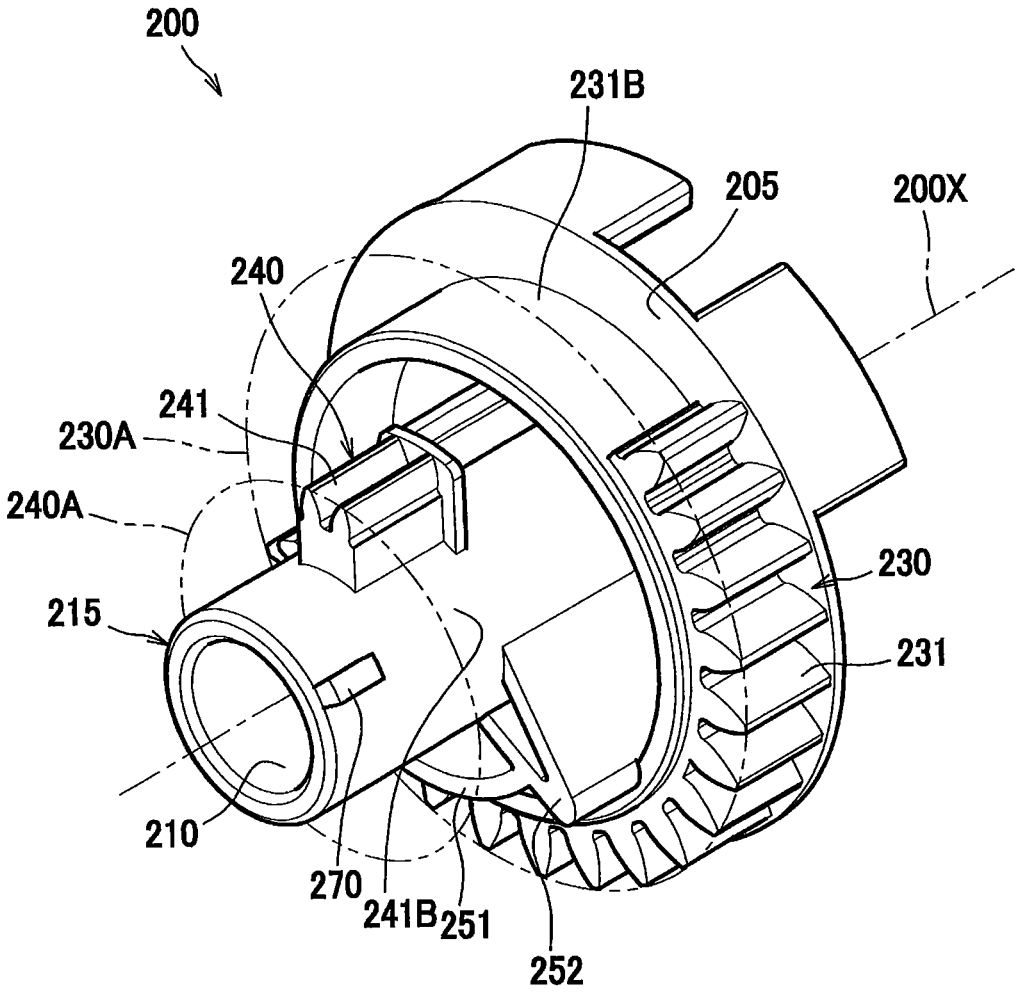
FIG. 7 is an enlarged perspective view of a detection gear of the developing cartridge.

The detection gear 200 includes a disk portion 205 extending in a direction crossing the axial direction. Preferably, the disk portion 205 extends in a direction orthogonal to the axial direction. As illustrated in FIG. 7, the detection gear 200 includes a third gear portion 230, a fourth gear portion 240, a first spring engagement portion 251, a second spring engagement portion 252, and a locking protrusion 270. The third gear portion 230, the fourth gear portion 240, the first spring engagement portion 251, the second spring engagement portion 252, and the locking protrusion 270 are positioned at one side of the disk portion 205 in the first direction.

The third gear portion 230 includes a plurality of gear teeth 231. The third gear portion 230 is positioned at a portion of the circumferential periphery of the detection gear 200. The gear teeth 231 of the third gear portion 230 are engageable with the gear teeth 111 of the first gear portion 110. The detection gear 200 includes a tooth-missing portion 231B positioned at a portion other than the third gear portion 230 on the circumferential periphery of the detection gear 200, and the portion is at the same position in the axial direction as the third gear portion 230. That is, the tooth-missing portion 231B is at the same position in the axial direction as the third gear portion 230. The tooth-missing portion 231B is a portion having no gear teeth 231.

The fourth gear portion 240 includes a plurality of gear teeth 241. The fourth gear portion 240 is rotatable about the second axis 200X together with the third gear portion 230. The gear teeth 241 of the fourth gear portion 240 is engageable with the gear teeth 121 of the second gear portion 120. An addendum circle 240A of the fourth gear portion 240 is smaller in diameter than an addendum circle 230A of the third gear portion 230.

The addendum circle 120A of the second gear portion 120 is greater than the addendum circle 110A of the first gear portion 110, and the addendum circle 240A of the fourth gear portion 240 is smaller than the addendum circle 230A of the third gear portion 230. Accordingly, the detection gear 200 rotates at a low speed in a case where the first gear portion 110 and the third gear portion 230 are in engagement with each other, while the detection gear 200 rotates at a high speed in a case where the second gear portion 120 and the fourth gear portion 240 are in engagement with each other.

The fourth gear portion 240 is positioned at a portion of the circumferential periphery of the detection gear 200. The detection gear 200 includes a tooth-missing portion 241B positioned at a portion other than the fourth gear portion 240 on the circumferential periphery of the detection gear 200, and the portion is at the same position in the axial direction as the fourth gear portion 240. That is, the tooth-missing portion 241B is at the same position in the axial direction as the fourth gear portion 240. The tooth-missing portion 241B is a portion having no gear teeth 241.

The fourth gear portion 240 is positioned at a position different from a position of the third gear portion 230 in the axial direction. Specifically, the fourth gear portion 240 is positioned closer to the casing 11 in the axial direction than the third gear portion 230 is to the casing 11. Further, the fourth gear portion 240 is positioned at a position different from a position of the third gear portion 230 in the rotational direction of the detection gear 200. Specifically, the fourth gear portion 240 is positioned downstream of and away from the third gear portion 230 in the rotational direction of the detection gear 200. The length of the third gear portion 230 in the rotational direction of the detection gear 200 is greater than the length of the fourth gear portion 240 in the rotational direction of the detection gear 200.

The first spring engagement portion 251 and the second spring engagement portion 252 engage with the torsion spring 500 to receive force from the torsion spring 500. The first spring engagement portion 251 protrudes in the axial direction from the disk portion 205. The first spring engagement portion 251 has a plate shape. The first spring engagement portion 251 is positioned farther from the second axis 200X in the radial direction of the detection gear 200 than the tubular portion 215 is from the second axis 200X. The first spring engagement portion 251 extends in the rotational direction of the detection gear 200.

The second spring engagement portion 252 protrudes outward from the tubular portion 215 in the radial direction of the detection gear 200. Further, the second spring engagement portion 252 protrudes in the axial direction from the disk portion 205. The second spring engagement portion 252 has a plate shape. The leading end of the second spring engagement portion 252 is positioned farther from the second axis 200X in the radial direction of the detection gear 200 than the first spring engagement portion 251 is from the second axis 200X. The second spring engagement portion 252 is positioned downstream of the first spring engagement portion 251 in the rotational direction of the detection gear 200.

The locking protrusion 270 protrudes outward in the radial direction of the detection gear 200 from the leading end of the tubular portion 215 which is positioned at one side of the tubular portion 215 in the first direction. The locking protrusion 270 is rotatable together with the detection gear 200. That is, the detection gear 200 includes the locking protrusion 270. In addition, the locking protrusion 270 is formed integrally with the detection gear 200. Further, the locking protrusion 270 engages with the locking protrusion 11H of the casing 11 to define the posture of the detection gear 200 after rotation of the detection gear 200.

As illustrated in FIG. 6, the detection gear 200 includes a first protrusion 261, a second protrusion 262, and a third protrusion 263. The first protrusion 261, the second protrusion 262, and the third protrusion 263 are positioned at another side of the disk portion 205 in the first direction.

The first protrusion 261 protrudes in the axial direction. Further, the first protrusion 261 protrudes in the radial direction of the detection gear 200. More specifically, the first protrusion 261 protrudes in the axial direction from the disk portion 205. Further, the first protrusion 261 protrudes outward in the radial direction of the detection gear 200 from the tubular portion 215. The first protrusion 261 is rotatable together with the detection gear 200. That is, the detection gear 200 includes the first protrusion 261. More specifically, the first protrusion 261 is formed integrally with the detection gear 200. In addition, the first protrusion 261 extends in the rotational direction of the detection gear 200. The first protrusion 261 extends along the outer circumferential surface of the disk portion 205.

The second protrusion 262 protrudes in the axial direction. Further, the second protrusion 262 protrudes in the radial direction of the detection gear 200. More specifically, the second protrusion 262 protrudes in the axial direction from the disk portion 205. The second protrusion 262 protrudes outward in the radial direction of the detection gear 200 from the tubular portion 215. The second protrusion 262 is positioned away from the first protrusion 261 in the rotational direction of the detection gear 200. Specifically, the second protrusion 262 is positioned upstream of the first protrusion 261 in the rotational direction of the detection gear 200. The second protrusion 262 is rotatable together with the detection gear 200. That is, the detection gear 200 includes the second protrusion 262. More specifically, the second protrusion 262 is formed integrally with the detection gear 200. The second protrusion 262 extends in the rotational direction of the detection gear 200. The second protrusion 262 extends along the outer circumferential surface of the disk portion 205.

The third protrusion 263 protrudes in the axial direction. More specifically, the third protrusion 263 protrudes in the axial direction from the disk portion 205. The third protrusion 263 is positioned away from the first protrusion 261 and the second protrusion 262 in the rotational direction of the detection gear 200. Specifically, the third protrusion 263 is positioned upstream of the first protrusion 261 and the second protrusion 262 in the rotational direction of the detection gear 200. The third protrusion 263 is rotatable together with the detection gear 200. That is, the detection gear 200 includes the third protrusion 263. More specifically, the third protrusion 263 is formed integrally with the detection gear 200. In addition, the third protrusion 263 extends in the rotational direction of the detection gear 200. The third protrusion 263 extends along the outer circumferential surface of the disk portion 205.

The first protrusion 261 is positioned at a position in the radial direction of the detection gear 200 where the first protrusion 261 can contact the main body lever 7A. The second protrusion 262 is positioned at a position in the radial direction of the detection gear 200 where the second protrusion 262 can contact the main body lever 7A. The third protrusion 263 is positioned at a position in the radial direction of the detection gear 200 where the third protrusion 263 can contact the main body lever 7A. The third protrusion 263, the second protrusion 262, and the first protrusion 261 are arranged in this order in a direction opposite to the rotational direction of the detection gear 200. The leading ends in the axial direction of the first protrusion 261, the second protrusion 262, and the third protrusion 263 each have a predetermined length in the rotational direction.

Figure 10A:
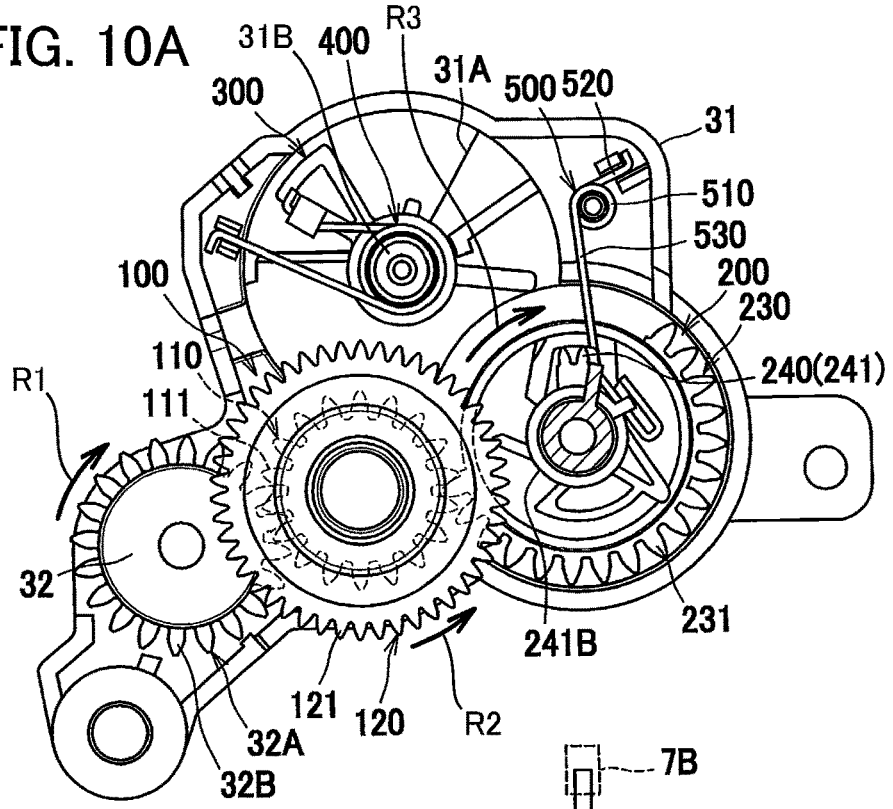
FIG. 10A is a view illustrating the detection gear and a detection lever as viewed from the inside of the developing cartridge, the view illustrating a state where the detection gear is positioned at an initial position.

The torsion spring 500 includes a coil portion 510, a first arm 520, and a second arm 530. The torsion spring 500 is an example of a spring. The first arm 520 extends from one end of the coil portion 510. The second arm 530 extends from another end of the coil portion 510. As illustrated in FIG. 10A, the first arm 520 is in contact with and fixed to the second gear cover 31. Alternatively, the first arm 520 may be in contact with and fixed to the casing 11.

Incidentally, for example, the fixed state of the first arm 520 to the second gear cover 31 (or the casing 11) may include a state where the first arm 520 is slightly movable relative to the second gear cover 31 (or the casing 11) with a slight play therebetween.

The second arm 530 is configured to contact the detection gear 200. In the state illustrated in FIG. 14A, the torsion spring 500 holds the detection gear 200 at a final position (described later). Specifically, in the state illustrated in FIG. 14A, the second arm 530 is in contact with the second spring engagement portion 252 of the detection gear 200 and urges the detection gear 200 in the rotational direction of the detection gear 200.

As illustrated in FIG. 6, the detection lever 300 is positioned at the other side of the casing 11 in the first direction. That is, the detection lever 300 is positioned at the outer surface 11E of the casing 11. The detection lever 300 is movable relative to the casing 11. More specifically, the detection lever 300 is swingably movable about a fourth axis 300X extending in the axial direction.

The detection lever 300 includes a tubular portion 315 having a hole 310. The lever shaft 31B of the second gear cover 31 is inserted into the hole 310 of the tubular portion 315, and the detection lever 300 is swingably movable about the lever shaft 31B. That is, the detection lever 300 is swingably supported by the second gear cover 31. The leading end of the lever shaft 31B is inserted into and supported by a support hole 11J which is formed at a side wall 11D positioned at another side of the lid 11B of the casing 11 in the first direction.

The detection lever 300 includes a gear contact portion 320, the lever contact portion 330, and a spring engagement portion 340.

The gear contact portion 320 and the lever contact portion 330 each extend outward from the tubular portion 315 in the radial direction of the tubular portion 315. The gear contact portion 320 has a plate shape. The gear contact portion 320 is positioned at a position where the leading end of the gear contact portion 320 can contact the first protrusion 261, the second protrusion 262 and the third protrusion 263 of the detection gear 200. The lever contact portion 330 is positioned at a position where the leading end of the lever contact portion 330 can contact the main body lever 7A.

The spring engagement portion 340 protrudes in the axial direction from the lever contact portion 330 and extends in the circumferential direction of the tubular portion 315. The spring engagement portion 340 is in engagement with the torsion spring 400 and receives force from the torsion spring 400.

Figure 12A:
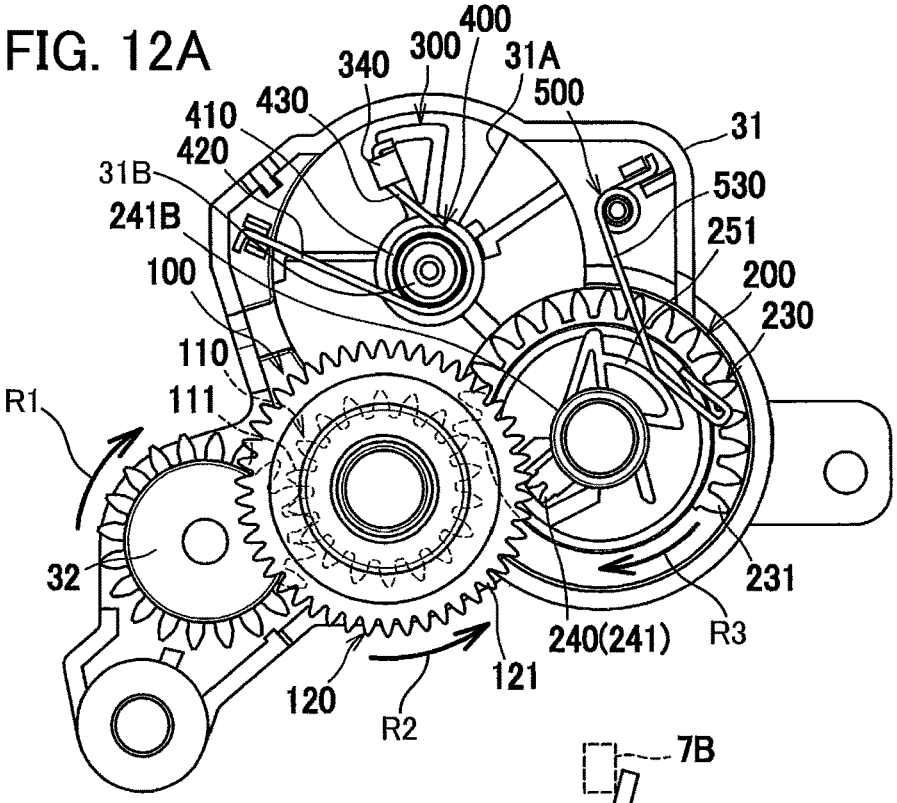
FIG. 12A is a view illustrating the detection gear and the detection lever as viewed from the inside of the developing cartridge, the view illustrating a state where the detection gear is positioned at the second rotational position.

The torsion spring 400 includes a coil portion 410, a first arm 420, and a second arm 430. The torsion spring 400 is an example of a spring. The first arm 420 extends from one end of the coil portion 410. The second arm 430 extends from another end of the coil portion 410. As illustrated in FIG. 12A, the first arm 420 is in contact with and fixed to the second gear cover 31. Alternatively, the first arm 420 may be in contact with and fixed to the casing 11.

Incidentally, for example, the fixed state of the first arm 420 to the second gear cover 31 (or the casing 11) may include a state where the first arm 420 is slightly movable relative to the second gear cover 31 (or the casing 11) with a slight play therebetween.

The torsion spring 400 urges the detection lever 300 to a first position (described later). Specifically, the second arm 430 contacts the spring engagement portion 340 of the detection lever 300 to urge the detection lever 300 toward the position illustrated in FIG. 12A.

The detection lever 300 is swingably movable between the first position and a second position. The first position is the position illustrated in FIG. 12B. The second position is, for example, the position illustrated in FIG. 10B to which the detection lever 300 swingably moves from the first position due to contact between the gear contact portion 320 and the first protrusion 261, the second protrusion 262, or the third protrusion 263 of the detection gear 200. The detection lever 300 can be returned from the second position to the first position by the urging force of the torsion spring 400.

Figure 12B:
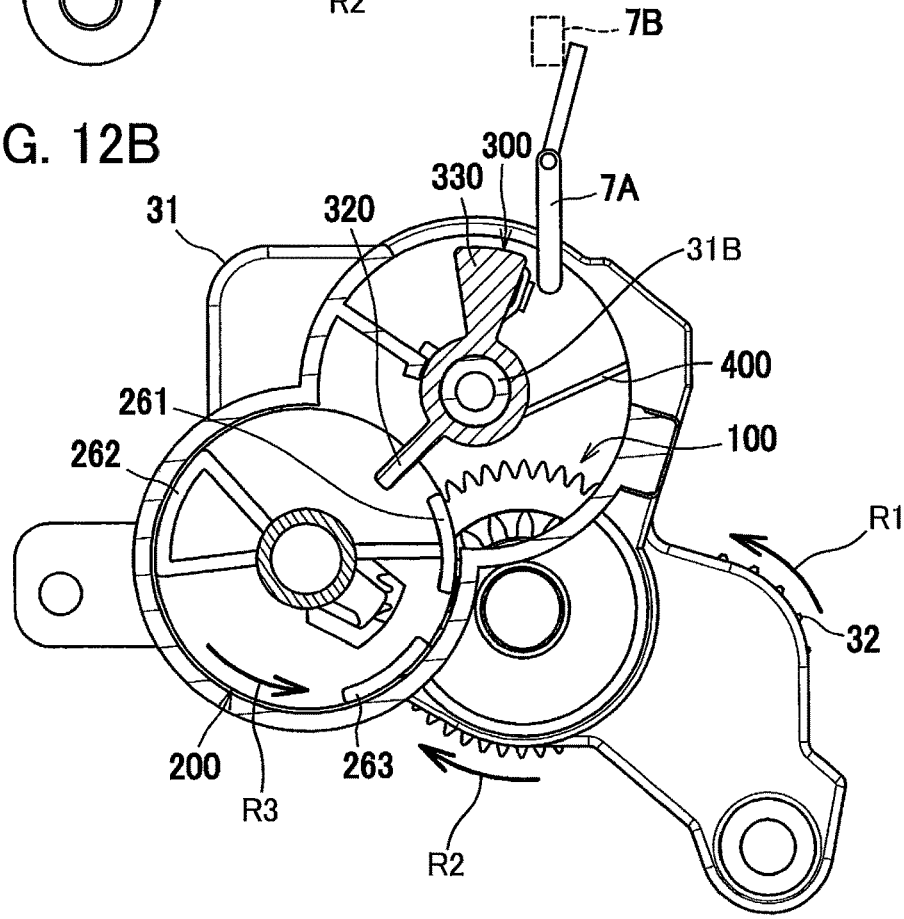
FIG. 12B is a view illustrating the detection gear and the detection lever as viewed from the outside of the developing cartridge, the view illustrating the state where the detection gear is positioned at the second rotational position.

When the detection lever 300 is positioned at the second position in a state where the developing cartridge 10 is attached to the laser printer 1, the lever contact portion 330 is in contact with the main body lever 7A. On the other hand, when the detection lever 300 is positioned at the first position in the state where the developing cartridge 10 is attached to the laser printer 1, the lever contact portion 330 is out of contact with the main body lever 7A, as illustrated in FIG. 12B. The main body lever 7A is an example of a portion of an image forming apparatus.

Figure 10B:
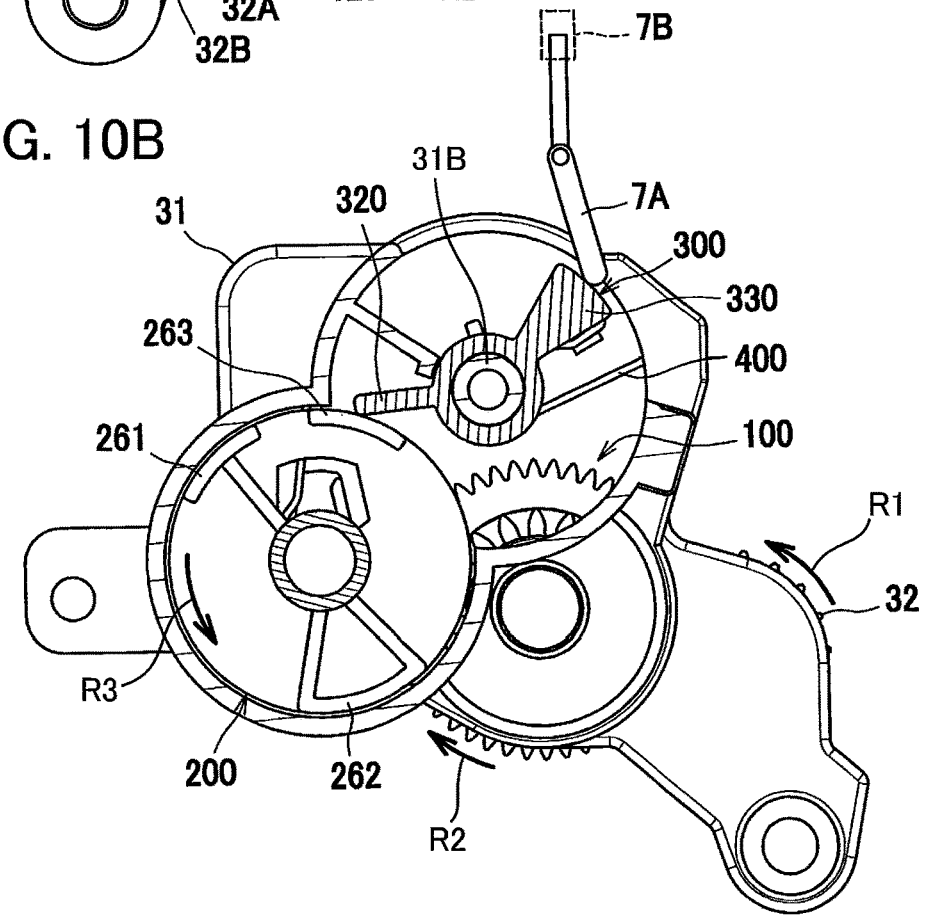
FIG. 10B is a view illustrating the detection gear and the detection lever as viewed from the outside of the developing cartridge, the view illustrating the state where the detection gear is positioned at the initial position.

In a case where the developing cartridge 10 is in an unused state, the detection gear 200 is positioned at the position illustrated in FIGS. 10A and 10B, relative to the second gear cover 31. Hereinafter, the positions of the idle gear 100 and the detection gear 200 illustrated in FIGS. 10A and 10B are each referred to as an initial position. The initial position of the detection gear 200 is an example of a first rotational position.

When the detection gear 200 is positioned at the initial position, the developing cartridge 10 is in an unused state. As illustrated in FIG. 10B, when the detection gear 200 is positioned at the initial position, the third protrusion 263 is in contact with the gear contact portion 320 of the detection lever 300. In this case, the detection lever 300 is positioned at the second position against the urging of the torsion spring 400 and is in contact with the main body lever 7A. As a result, the main body lever 7A is positioned between the light-emitting portion and the light-receiving portion of the optical sensor 7B, thereby causing light emitted from the light-emitting portion to be shielded by the main body lever 7A.

The detection gear 200 is rotatable from the initial position to a second rotational position, and further, from the second rotational position to the final position. The second rotational position is, for example, the position illustrated in FIG. 12A where the second gear portion 120 starts engaging with the fourth gear portion 240. The final position is the position illustrated in FIGS. 14A and 14B. The final position of the detection gear 200 is an example of a third rotational position.

Not only when the detection gear 200 is positioned at the initial position illustrated in FIG. 10A but also when the detection gear 200 rotates from the initial position to the second rotational position, the gear teeth 111 of the first gear portion 110 are in engagement with the gear teeth 231 of the third gear portion 230. In these cases, the gear teeth 121 of the second gear portion 120 and the gear teeth 241 of the fourth gear portion 240 are not engaged with each other. In other words, the gear teeth 121 of the second gear portion 120 face the tooth-missing portion 241B of the fourth gear portion 240.

Figure 13A:
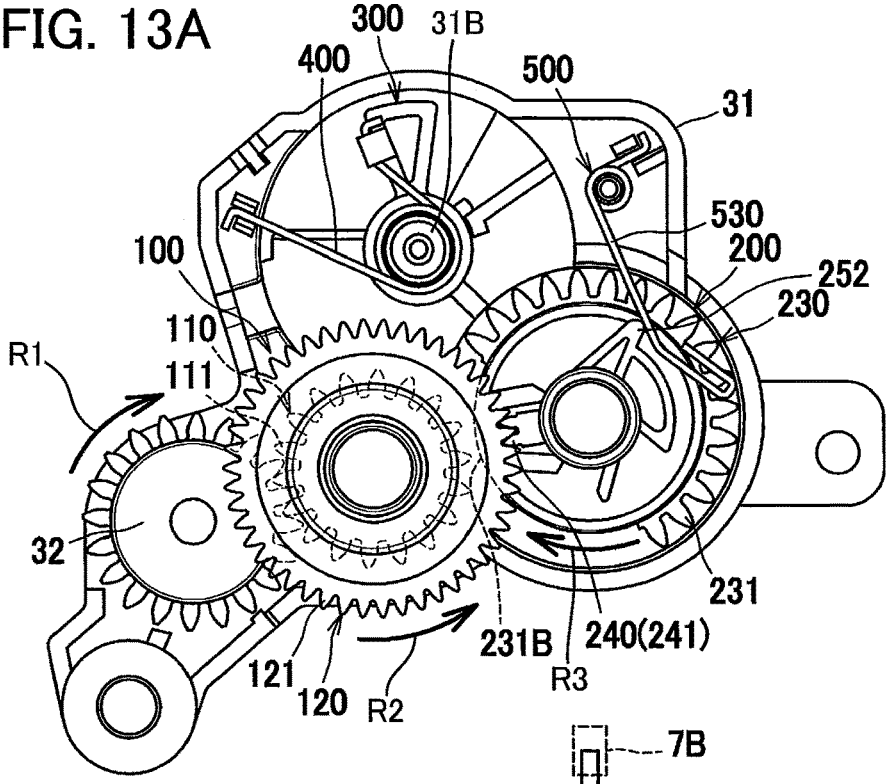
FIG. 13A is a view illustrating the detection gear and the detection lever as viewed from the inside of the developing cartridge, the view illustrating a process of rotation of the detection gear from the second rotational position to a final position.

When the detection gear 200 rotates from the second rotational position to the final position, the gear teeth 121 of the second gear portion 120 engage with the gear teeth 241 of the fourth gear portion 240 in the middle of the rotation of the detection gear 200 from the second rotational position to the final position, as illustrated in FIG. 13A. In this case, the engagement between the gear teeth 111 of the first gear portion 110 and the gear teeth 231 of the third gear portion 230 is released, and afterward, the gear teeth 111 of the first gear portion 110 and the gear teeth 231 of the third gear portion 230 are not engaged with each other. In other words, the gear teeth 111 of the first gear portion 110 face the tooth-missing portion 231B of the third gear portion 230.

More specifically, when the detection gear 200 rotates from the initial position to the final position, the detection gear 200 is rotatable from a first engagement position to a second engagement position and further from the second engagement position to a non-engagement position.

The first engagement position is the position illustrated in FIG. 10A where the gear teeth 231 of the third gear portion 230 are in engagement with the gear teeth 111 of the first gear portion 110 and the gear teeth 241 of the fourth gear portion 240 are not engaged with the gear teeth 121 of the second gear portion 120.

The second engagement position is the position illustrated in FIG. 13A where the gear teeth 231 of the third gear portion 230 are not engaged with the gear teeth 111 of the first gear portion 110 and the gear teeth 241 of the fourth gear portion 240 are in engagement with the gear teeth 121 of the second gear portion 120.

Figure 14A:
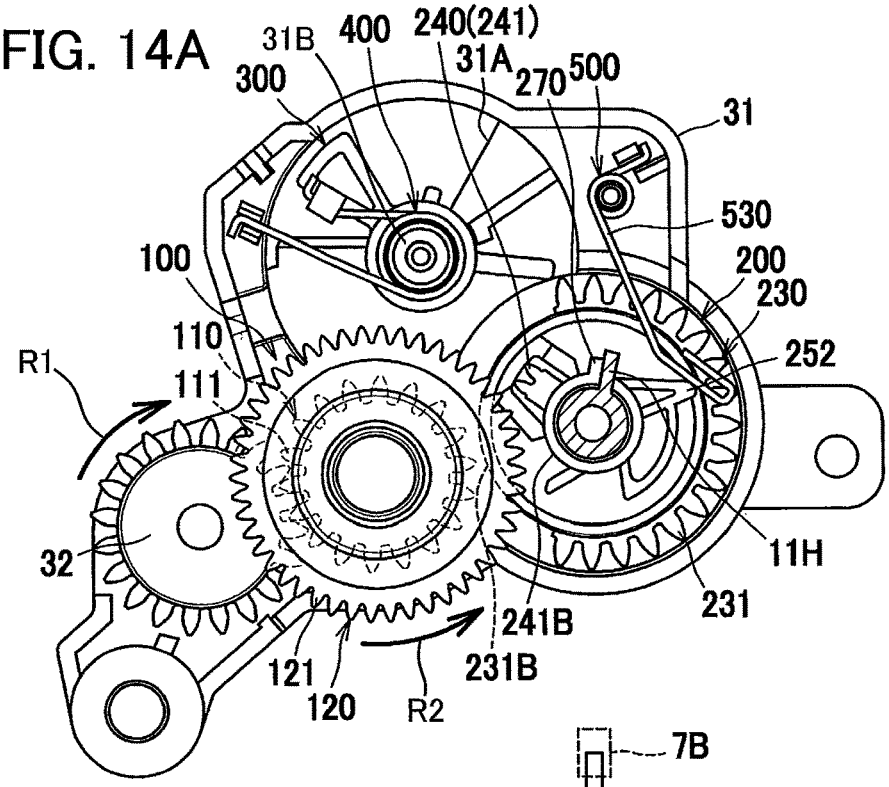
FIG. 14A is a view illustrating the detection gear and the detection lever as viewed from the inside of the developing cartridge, the view illustrating a state where the detection gear is positioned at the final position.
Figure 14B:
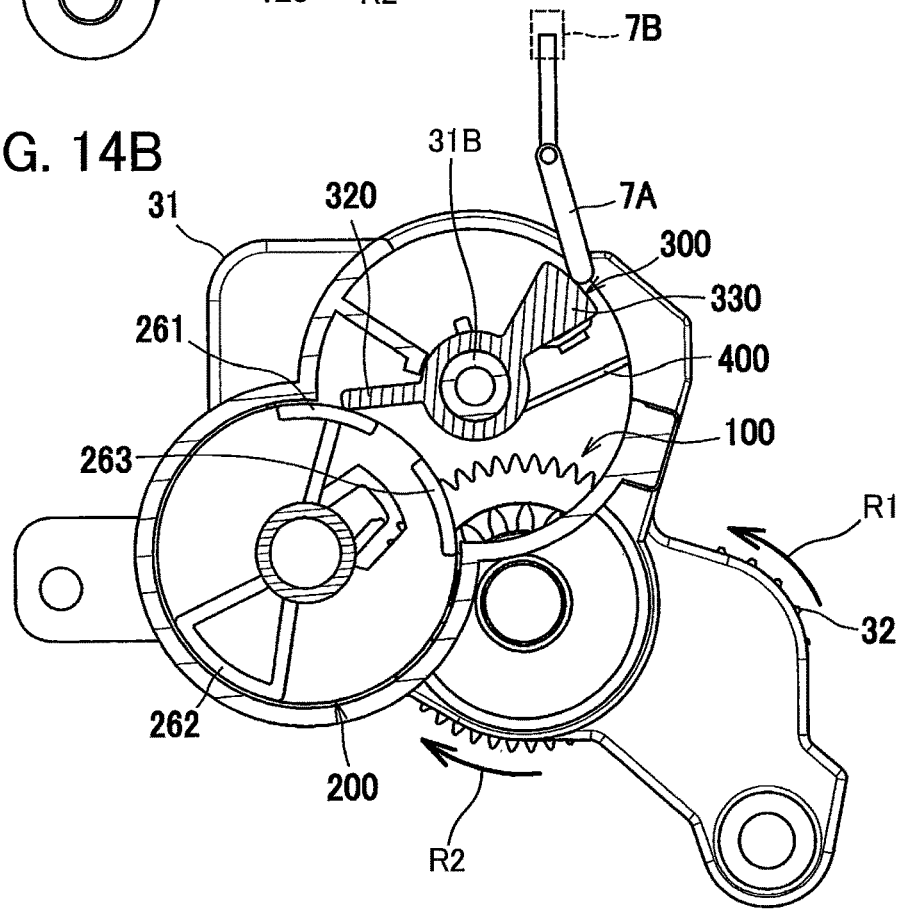
FIG. 14B is a view illustrating the detection gear and the detection lever as viewed from the outside of the developing cartridge, the view illustrating the state where the detection gear is positioned at the final position.

The non-engagement position is the position illustrated in FIG. 14A where the gear teeth 231 of the third gear portion 230 are not engaged with the gear teeth 111 of the first gear portion 110 and the gear teeth 241 of the fourth gear portion 240 are not engaged with the gear teeth 121 of the second gear portion 120.

The detection gear 200 rotates from the initial position illustrated in FIG. 10A to the final position illustrated in FIG. 14A via the second rotational position illustrated in FIG. 12A and then is stopped. That is, the detection gear 200 is rotatable from the initial position to the final position. In a state where the detection gear 200 is positioned at the final position, the torsion spring 500 is in contact with the second spring engagement portion 252 and urges the detection gear 200 in the rotational direction of the detection gear 200. At the final position of the detection gear 200, the locking protrusion 270 is in contact with the locking protrusion 11H and is pressed against the locking protrusion 11H by the urging force of the torsion spring 500.

Although details will be described later, when any one of the third protrusion 263, the second protrusion 262, and the first protrusion 261 is in contact with the detection lever 300, the detection lever 300 is positioned at the second position. In this case, for example, as illustrated in FIG. 10B, the detection lever 300 is in contact with the main body lever 7A, and the main body lever 7A is positioned between the light-emitting portion and the light-receiving portion of the optical sensor 7B. As a result, light emitted from the light-emitting portion is shielded by the main body lever 7A to prevent the light-receiving portion from receiving the light emitted from the light-emitting portion.

Figure 11A:
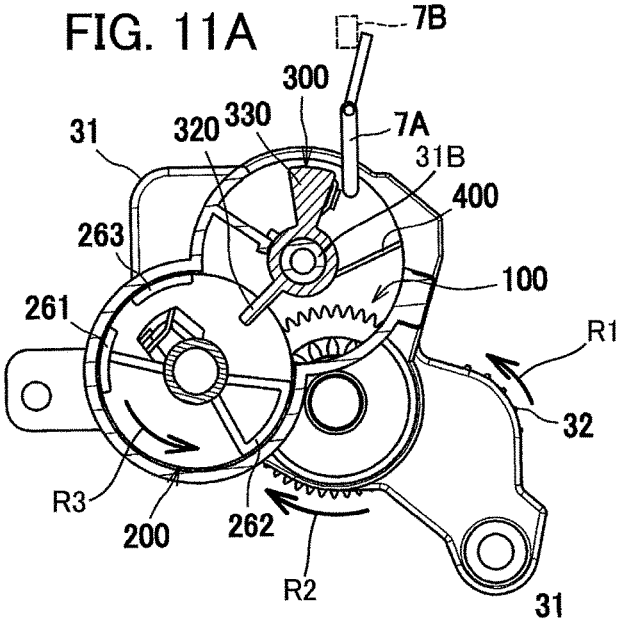
FIG. 11A is a view illustrating the detection gear and the detection lever as viewed from the outside of the developing cartridge, the view illustrating a process of rotation of the detection gear from the initial position to a second rotational position.

When none of the third protrusion 263, the second protrusion 262, and the first protrusion 261 is in contact with the detection lever 300, the detection lever 300 is positioned at the first position. In this case, for example, as illustrated in FIG. 11A, the detection lever 300 is out of contact with the main body lever 7A, and the main body lever 7A is not positioned between the light-emitting portion and the light-receiving portion of the optical sensor 7B. As a result, light emitted from the light-emitting portion is not shielded by the main body lever 7A, thereby allowing the light-receiving portion to receive the light emitted from the light-emitting portion.

The laser printer 1 identifies the specification of the developing cartridge 10 by making use of a detection signal obtained on the basis of changes between a state where the light-receiving portion receives light and a state where the light-receiving portion does not receive light.

Further, in the present embodiment, the detection lever 300 is in contact with the main body lever 7A when the detection gear 200 is positioned at the initial position, and the detection lever 300 is in contact with the main body lever 7A even when the detection gear 200 is positioned at the final position. Thus, by virtue of using the detection lever 300, the laser printer 1 can determine whether or not the developing cartridge 10 is attached to the laser printer 1.

Figure 8:
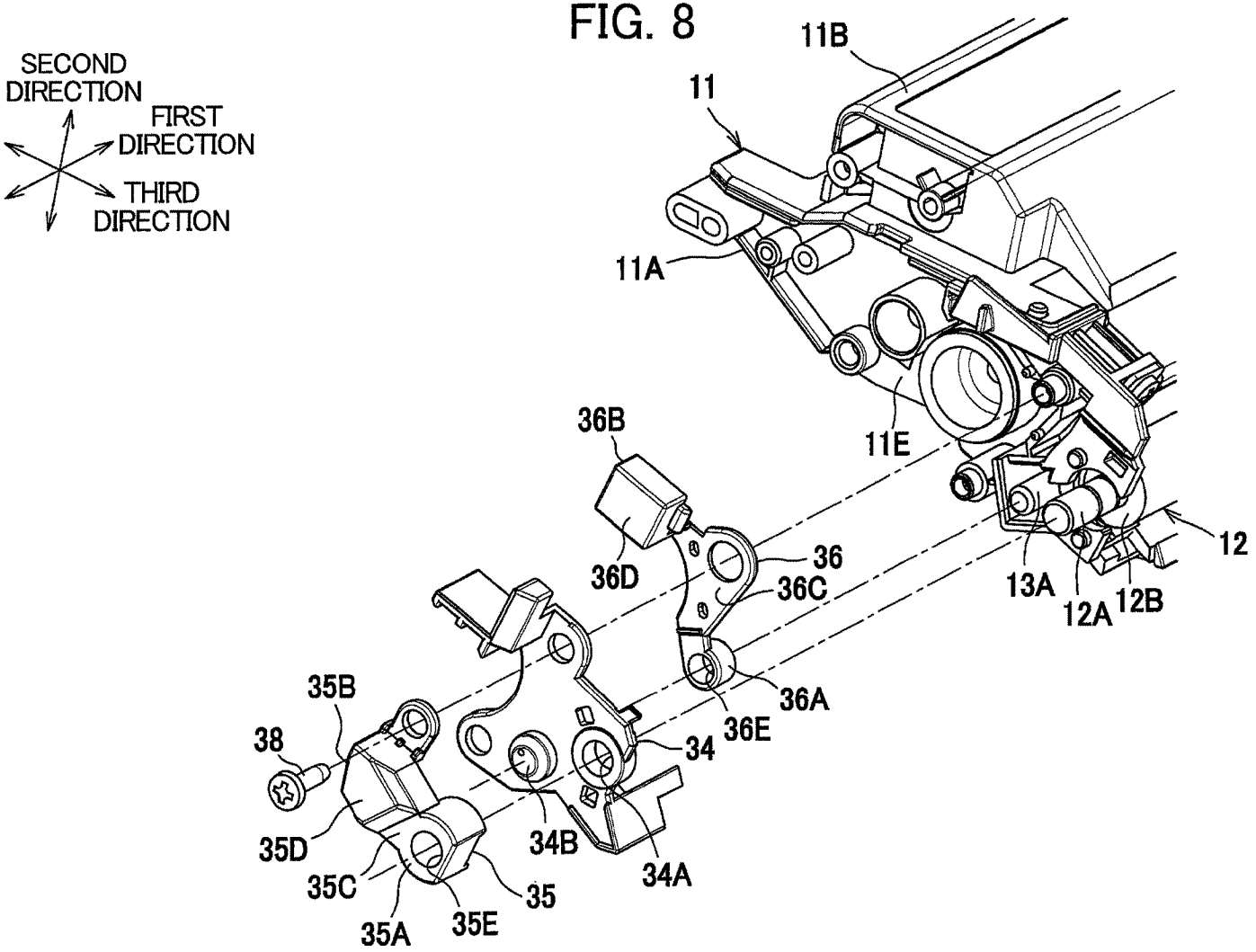
FIG. 8 is an exploded perspective view of parts of electrodes positioned at the other side in the first direction of the casing of the developing cartridge.

As illustrated in FIG. 8, the second bearing member 34 includes a first support portion 34A and a second support portion 34B. The first support portion 34A rotatably supports the developing roller shaft 12A. The second support portion 34B rotatably supports the supply roller shaft 13A. In a state where the second bearing member 34 supports the developing roller shaft 12A and the supply roller shaft 13A, the second bearing member 34 is fixed to the outer surface 11E defined at the other side of the container 11A of the casing 11 in the first direction.

The developing electrode 35 is positioned at the other side of the casing 11 in the first direction. That is, the developing electrode 35 is positioned at the outer surface 11E. The developing electrode 35 is configured to supply electric power to the developing roller shaft 12A. For example, the developing electrode 35 is made of electrically conductive resin.

The developing electrode 35 includes a first electrical contact 35A, a second electrical contact 35B, and a connection portion 35C. The first electrical contact 35A is in contact with the developing roller shaft 12A. The connection portion 35C couples the first electrical contact 35A and the second electrical contact 35B to thereby electrically connect the first electrical contact 35A and the second electrical contact 35B.

The first electrical contact 35A has a contact hole 35E. The developing roller shaft 12A is inserted into the contact hole 35E. Preferably, the contact hole 35E is a circular hole. In a state where the developing roller shaft 12A is inserted into the contact hole 35E, the first electrical contact 35A is in contact with a portion of the developing roller shaft 12A. Specifically, in the state where the developing roller shaft 12A is inserted into the contact hole 35E, the first electrical contact 35A is in contact with the outer circumferential surface of the developing roller shaft 12A.

The second electrical contact 35B of the developing electrode 35 includes a developing contact surface 35D extending in the second direction and the third direction.

The supply electrode 36 is positioned at the other side of the casing 11 in the first direction. That is, the supply electrode 36 is positioned at the outer surface 11E. The supply electrode 36 is configured to supply electric power to the supply roller shaft 13A. For example, the supply electrode 36 is made of electrically conductive resin.

The supply electrode 36 includes a third electrical contact 36A, a fourth electrical contact 36B, and a connection portion 36C. The third electrical contact 36A is in contact with the supply roller shaft 13A. The connection portion 36C couples the third electrical contact 36A and the fourth electrical contact 36B to thereby electrically connect the third electrical contact 36A and the fourth electrical contact 36B.

The third electrical contact 36A has a contact hole 36E. The supply roller shaft 13A is inserted into the contact hole 36E. Preferably, the contact hole 36E is a circular hole. In a state where the supply roller shaft 13A is inserted into the contact hole 36E, the third electrical contact 36A is in contact with a portion of the supply roller shaft 13A. Specifically, in the state where the supply roller shaft 13A is inserted into the contact hole 36E, the third electrical contact 36A is in contact with the outer circumferential surface of the supply roller shaft 13A. The fourth electrical contact 36B of the supply electrode 36 includes a supply contact surface 36D extending in the second direction and the third direction.

The developing electrode 35 and the supply electrode 36 are fixed, together with the second bearing member 34, to the outer surface 11E defined at the other side of the casing 11 in the first direction with a screw 38.

Figure 9:
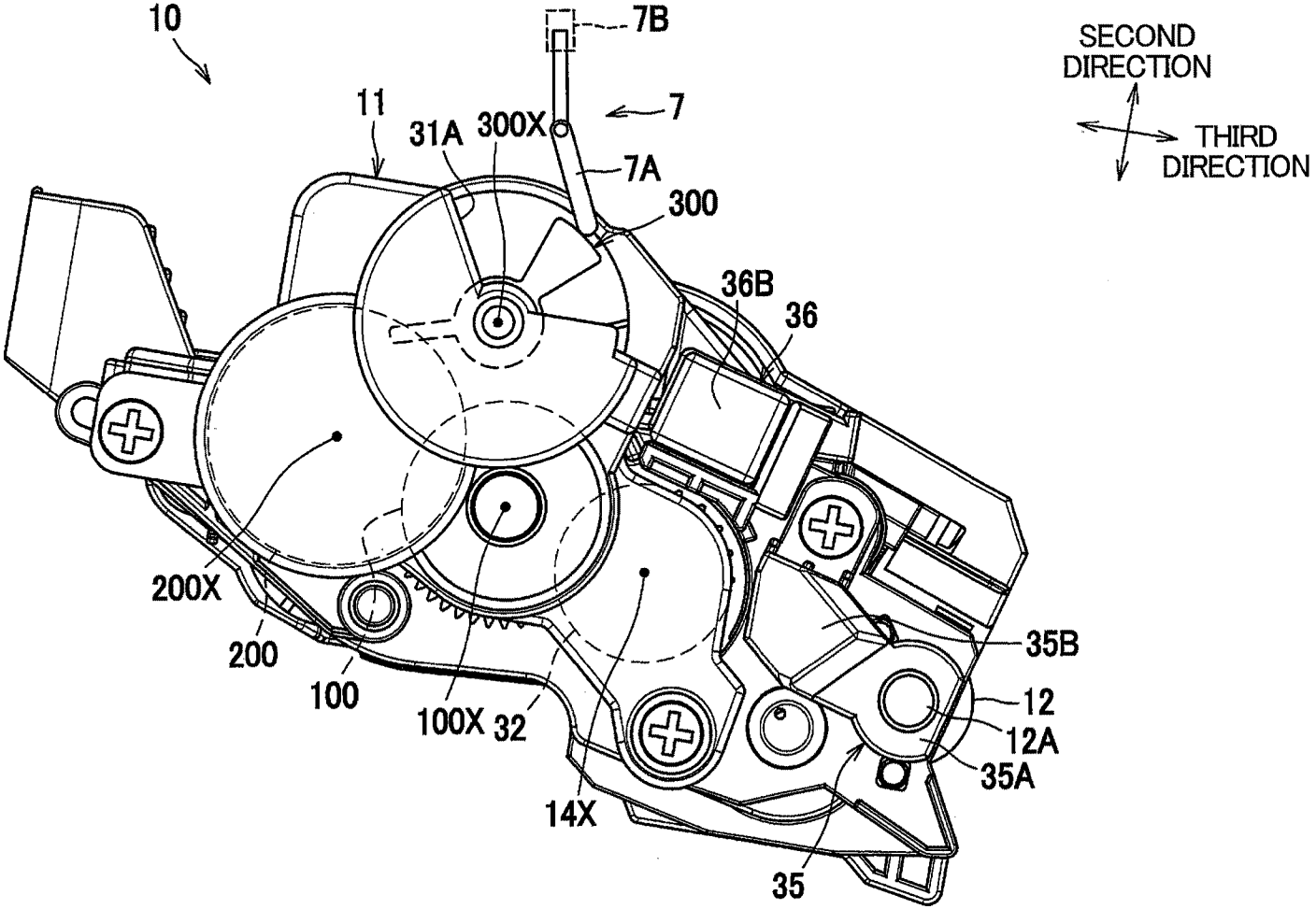
FIG. 9 is a side view illustrating the other side in the first direction of the developing cartridge.

As illustrated in FIG. 9, the second electrical contact 35B of the developing electrode 35 is positioned closer to the developing roller shaft 12A in the third direction than the second agitator gear 32 is to the developing roller shaft 12A. The second electrical contact 35B is positioned farther from the developing roller shaft 12A in the third direction than the first electrical contact 35A is from the developing roller shaft 12A.

The fourth electrical contact 36B of the supply electrode 36 is positioned farther from the developing roller shaft 12A in both the second direction and the third direction than the second electrical contact 35B is from the developing roller shaft 12A.

The third axis 14X of the second agitator gear 32 is positioned closer to the developing roller shaft 12A in the second direction than the fourth electrical contact 36B is to the developing roller shaft 12A.

The first axis 100X of the idle gear 100 is positioned farther from the developing roller shaft 12A in the third direction than the fourth electrical contact 36B is from the developing roller shaft 12A. The first axis 100X is positioned closer to the developing roller shaft 12A in the second direction than the fourth electrical contact 36B is to the developing roller shaft 12A. The first axis 100X is positioned farther from the developing roller shaft 12A in the third direction than the third axis 14X of the second agitator gear 32 is from the developing roller shaft 12A.

The detection gear 200 is positioned farther from the developing roller shaft 12A in the third direction than the second electrical contact 35B is from the developing roller shaft 12A. The detection gear 200 is positioned farther from the developing roller shaft 12A in the third direction than the fourth electrical contact 36B is from the developing roller 12A.

The second axis 200X of the detection gear 200 is positioned farther from the developing roller shaft 12A in the third direction than the first axis 100X of the idle gear 100 is from the developing roller shaft 12A. In other words, the detection gear 200 is positioned at another end portion of the casing 11 in the third direction.

The detection lever 300 is positioned farther from the developing roller shaft 12A in the third direction than the fourth electrical contact 36B is from the developing roller shaft 12A.

The fourth axis 300X of the detection lever 300 is positioned closer to the developing roller shaft 12A in the third direction than the second axis 200X of the detection gear 200 is to the developing roller shaft 12A. The fourth axis 300X is positioned farther from the developing roller shaft 12A in the third direction than the third axis 14X of the second agitator gear 32 is from the developing roller shaft 12A. The fourth axis 300X is positioned farther from the developing roller shaft 12A in the second direction than the first axis 100X of the idle gear 100 is from the developing roller shaft 12A. The fourth axis 300X is positioned farther from the developing roller shaft 12A in the second direction than the second axis 200X of the detection gear 200 is from the developing roller shaft 12A.

Functions and effects of the developing cartridge 10 configured as described above will be described. For attaching the developing cartridge 10 to the laser printer 1, the developing cartridge 10 moves toward the inside of the main body housing 2 in the third direction with the developing roller 12 in the lead, as illustrated in FIG. 1.

Further, when the developing cartridge 10 is in an unused state as illustrated in FIG. 1, the detection lever 300 is positioned at the second position. Thus, the leading end of the lever contact portion 330 of the detection lever 300 contacts the main body lever 7A to cause the main body lever 7A to swingably move. As described above, when the optical sensor 7B detects displacement of the main body lever 7A, the control device CU can determine that the developing cartridge 10 is attached.

When the laser printer 1 starts to be driven according to an instruction from the control device CU, the coupling 22 illustrated in FIG. 4 rotates to rotate the first agitator gear 25 through the idle gear 26. By this rotation of the first agitator gear 25, the second agitator gear 32 positioned at the other side of the casing 11 in the first direction rotates in an arrow direction R1 via the agitator shaft 14A, as illustrated in FIG. 10A.

Upon the rotation of the second agitator gear 32, the idle gear 100 rotates in an arrow direction R2. This is because the gear teeth 32B of the gear portion 32A is in engagement with the gear teeth 111 of the first gear portion 110 of the idle gear 100. Further, the detection gear 200 rotates in an arrow direction R3 at a low speed in accordance with the rotation of the idle gear 100 since the gear teeth 111 of the first gear portion 110 is in engagement with the gear teeth 231 of the third gear portion 230 of the detection gear 200.

As illustrated in FIG. 10B, in a case where the detection gear 200 is positioned at the initial position, the third protrusion 263 is in contact with the gear contact portion 320 of the detection lever 300 and thus the detection lever 300 is positioned at the second position. Therefore, when the detection gear 200 rotates from the initial position toward the second rotational position, the contact between the third protrusion 263 and the gear contact portion 320 of the detection lever 300 first is released, as illustrated in FIG. 11A.

Then, the torsion spring 400 urges the detection lever 300 to move the detection lever 300 from the second position to the first position. Upon the movement of the detection lever 300 from the second position to the first position, the leading end of the lever contact portion 330 separates from the main body lever 7A to be out of contact with the main body lever 7A. As a result, the main body lever 7A is no longer positioned between the light-emitting portion and the light-receiving portion of the optical sensor 7B, and thus the signal received by the light-receiving portion is changed.

Figure 11B:
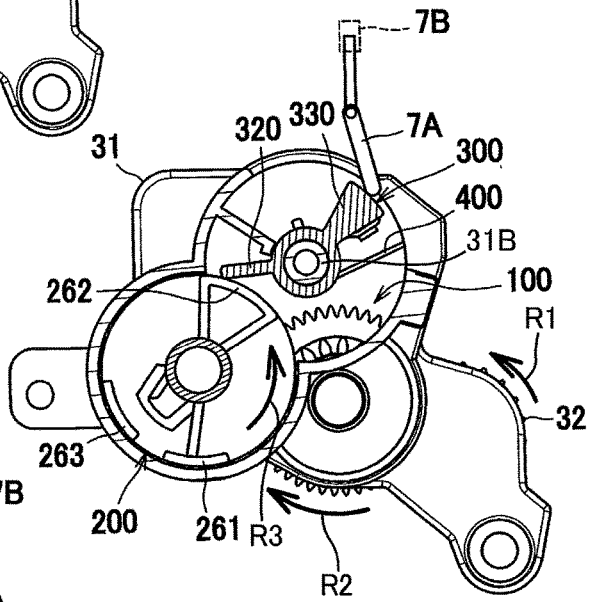
FIG. 11B is a view illustrating the detection gear and the detection lever as viewed from the outside of the developing cartridge, the view illustrating the process of rotation of the detection gear from the initial position to the second rotational position.

Thereafter, when the detection gear 200 further rotates at the low speed, the second protrusion 262 contacts the gear contact portion 320 of the detection lever 300. Then, when the detection gear 200 further rotates at the low speed, the second protrusion 262 moves the detection lever 300 from the first position to the second position against the urging force of the torsion spring 400, as illustrated in FIG. 11B. The movement of the detection lever 300 from the first position to the second position causes the leading end of the lever contact portion 330 to contact the main body lever 7A. As a result, the main body lever 7A is positioned between the light-emitting portion and the light-receiving portion of the optical sensor 7B, and the signal received by the light-receiving portion is changed.

In this case, since the detection lever 300 is pushed by the second protrusion 262 of the detection gear 200 rotating at the low speed, the detection lever 300 moves from the first position to the second position at a low speed. The main body lever 7A is pushed and moved by movement of the detection lever 300 from the first position to the second position. Accordingly, when the detection lever 300 moves from the first position to the second position at the low speed, the main body lever 7A also moves at a low speed to a position between the light-emitting portion and the light-receiving portion of the optical sensor 7B.

Figure 11C:
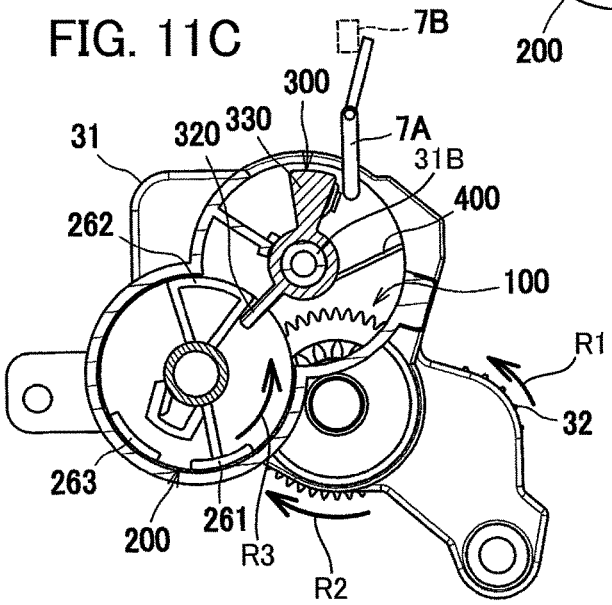
FIG. 11C is a view illustrating the detection gear and the detection lever as viewed from the outside of the developing cartridge, the view illustrating the process of rotation of the detection gear from the initial position to the second rotational position.

Thereafter, when the detection gear 200 further rotates, the contact between the second protrusion 262 and the gear contact portion 320 of the detection lever 300 is released, as illustrated in FIG. 11C. Then, the torsion spring 400 urges the detection lever 300 to move the detection lever 300 from the second position to the first position, thereby causing the leading end of the lever contact portion 330 to be out of contact with the main body lever 7A. As a result, the main body lever 7A is no longer positioned between the light-emitting portion and the light-receiving portion of the optical sensor 7B, and thus the signal received by the light-receiving portion is changed.

After then, when the detection gear 200 further rotates, the gear teeth 231 of the third gear portion 230 of the detection gear 200 separate from the gear teeth 111 of the first gear portion 110 of the idle gear 100 as illustrated in FIG. 12A. As a result, engagement between the third gear portion 230 and the first gear portion 110 is released. Accordingly, the rotational force of the idle gear 100 is no longer transmitted to the detection gear 200. However, at this time, the second arm 530 of the torsion spring 500 is in contact with the first spring engagement portion 251 of the detection gear 200 and applies a rotational force to the detection gear 200. By the applied rotational force, the detection gear 200 rotates in the arrow direction R3 even immediately after release of the engagement between the third gear portion 230 and the first gear portion 110.

Then, as illustrated in FIG. 13A, the gear teeth 241 of the fourth gear portion 240 of the detection gear 200 engage with the gear teeth 121 of the second gear portion 120 of the idle gear 100. As a result, the rotational force of the idle gear 100 is transmitted to the detection gear 200 through the second gear portion 120 and the fourth gear portion 240, thereby causing the detection gear 200 to rotate in the arrow direction R3 at a high speed.

Figure 13B:
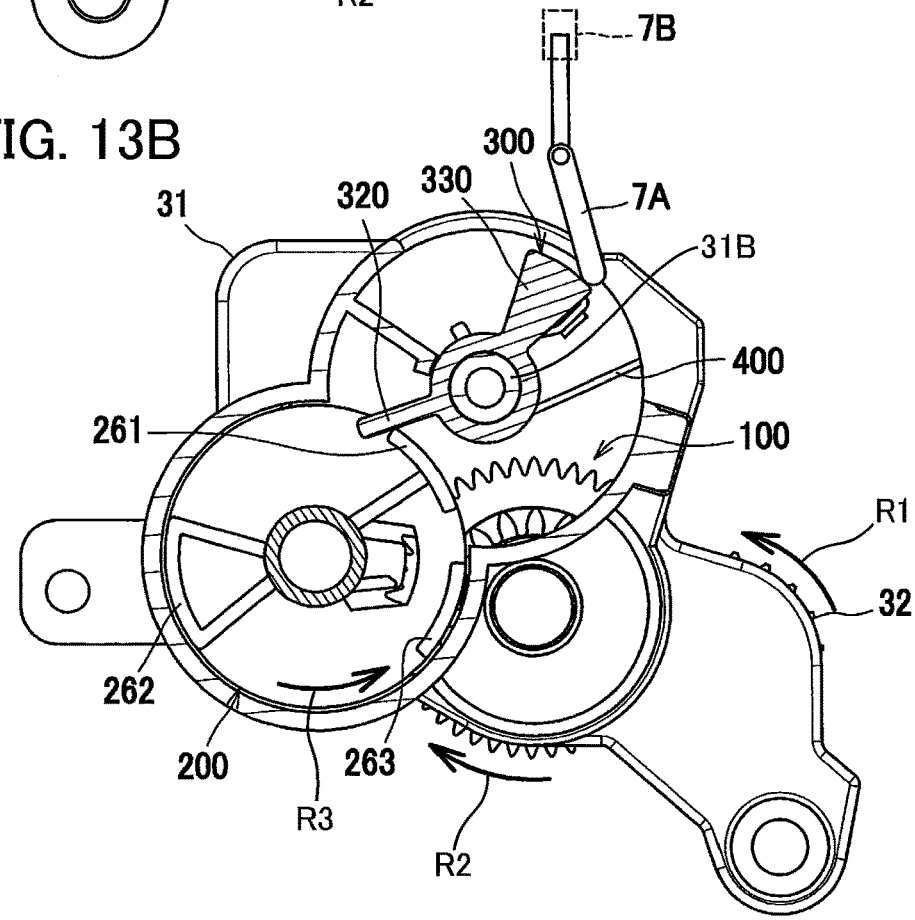
FIG. 13B is a view illustrating the detection gear and the detection lever as viewed from the outside of the developing cartridge, the view illustrating the process of rotation of the detection gear from the second rotational position to the final position.

When the detection gear 200 rotates in a state where the second gear portion 120 and the fourth gear portion 240 are in engagement with each other, the first protrusion 261 moves from the position illustrated in FIG. 12B to the position illustrated in FIG. 13B to contact the gear contact portion 320 of the detection lever 300. By this rotation, the first protrusion 261 moves the detection lever 300 from the first position to the second position against the urging force of the torsion spring 400, thereby causing the leading end of the lever contact portion 330 to contact the main body lever 7A. As a result, the main body lever 7A is positioned between the light-emitting portion and the light-receiving portion of the optical sensor 7B, and therefore the signal received by the light-receiving portion is changed.

In this case, since the detection lever 300 is pushed by the first protrusion 261 of the detection gear 200 rotating at the high speed, the detection lever 300 moves from the first position to the second position at a high speed. Thus, the main body lever 7A pushed by movement of the detection lever 300 from the first position to the second position at the high speed also moves to a position between the light-emitting portion and the light-receiving portion of the optical sensor 7B at a high speed.

Then, when the detection gear 200 rotates, the gear teeth 241 of the fourth gear portion 240 separate from the gear teeth 121 of the second gear portion 120 of the idle gear 100, thereby causing the engagement between the fourth gear portion 240 and the second gear portion 120 to be released. As a result, the rotational force of the idle gear 100 is no longer transmitted to the detection gear 200. However, at this time, the second arm 530 of the torsion spring 500 is in contact with the second spring engagement portion 252 of the detection gear 200 and applies a rotational force to the detection gear 200. By the applied rotational force, the detection gear 200 rotates further in the arrow direction R3 to be positioned at the final position illustrated in FIGS. 14A and 14B.

At the final position of the detection gear 200, the first protrusion 261 is in contact with the gear contact portion 320 of the detection lever 300, and the detection lever 300 is positioned at the second position. Further, at the final position of the detection gear 200, the gear teeth 111 of the first gear portion 110 of the idle gear 100 face the tooth-missing portion 231B of the detection gear 200 and are not meshingly engaged with any of the plurality of gear teeth 231.

Further, at the final position of the detection gear 200, the gear teeth 121 of the second gear portion 120 of the idle gear 100 face the tooth-missing portion 241B of the detection gear 200 and are not meshingly engaged with any of the plurality of gear teeth 241.

Moreover, at the final position of the detection gear 200, the orientation of the detection gear 200 (i.e., the posture of the detection gear 200) is maintained by the urging force of the torsion spring 500 and the contact between the locking protrusion 11H and the locking protrusion 270. Thus, afterward, the detection gear 200 does not rotate even when the second agitator gear 32 and the idle gear 100 rotate.

In the above operation process, the output of the optical sensor 7B is switched four times after the start of rotation of the detection gear 200. The output switching pattern (i.e., any one or any combination of: difference in length of an OFF signal or an ON signal; difference in the number of times of switching; and difference in the switching timing) can be changed by modifying at least one of the number of protrusions which rotates together with the detection gear 200 and the sizes of the protrusions in the rotational direction. By associating in advance the signal pattern with the specification of the developing cartridge 10, the control device CU can identify the specification of the developing cartridge 10.

In a case where a used developing cartridge 10 is attached to the main body housing 2 of the laser printer 1, the leading end of the lever contact portion 330 of the detection lever 300 comes into contact with the main body lever 7A since, in the used developing cartridge 10, the detection gear 200 is positioned at the final position and the detection lever 300 is positioned at the second position. Accordingly, the control device CU can determine that the developing cartridge 10 is attached.

According to the above-described developing cartridge 10, the rotational speed of the detection gear 200 can be made different between: a case where the detection gear 200 rotates in a state where the second gear portion 120 of the idle gear 100 and the fourth gear portion 240 of the detection gear 200 are in engagement with each other; and a case where the detection gear 200 rotates in a state where the first gear portion 110 of the idle gear 100 and the third gear portion 230 of the detection gear 200 are in engagement with each other. Specifically, when the detection gear 200 rotates in a state where the second gear portion 120 and the fourth gear portion 240 are in engagement with each other, the detection gear 200 can rotate at a high speed; while when the detection gear 200 rotates in a state where the first gear portion 110 and the third gear portion 230 are in engagement with each other, the detection gear 200 can rotate at a low speed. As a result, motion of the gear structure can be diversified in response to the diversification of the specification of the developing cartridge 10.

Further, the detection lever 300 can also move when the detection gear 200 rotates in a state where the first gear portion 110 and the third gear portion 230 are in engagement with each other. Thus, the moving speed of the detection lever 300 can be changed between: when the detection gear 200 rotates in a state where the first gear portion 110 and the third gear portion 230 are in engagement with each other; and when the detection gear 200 rotates in a state where the second gear portion 120 and the fourth gear portion 240 are in engagement with each other. Specifically, when the detection gear 200 rotates in a state where the first gear portion 110 and the third gear portion 230 are in engagement with each other, the detection lever 300 can swingably move at a low speed; while when the detection gear 200 rotates in a state where the second gear portion 120 and the fourth gear portion 240 are in engagement with each other, the detection lever 300 can swingably move at a high speed. As a result, the motion of the gear structure can be diversified.

Further, during rotation of the detection gear 200 from the initial position to the second rotational position, the detection lever 300 can move from the second position to the first position by releasing contact between the third protrusion 263 and the detection lever 300, and further, the detection lever 300 can move from the first position to the second position by bringing the second protrusion 262 and the detection lever 300 into contact with each other. As a result, the motion of the gear structure can be further diversified.

Further, the position of the fourth gear portion 240 in the rotational direction of the detection gear 200 differs from the position of the third gear portion 230 in the rotational direction of the detection gear 200, thereby preventing engagement between the first gear portion 110 and the third gear portion 230 and engagement between the second gear portion 120 and the fourth gear portion 240 from being made at the same time. Accordingly, a stable operation can be achieved.

While the embodiment of the present disclosure has been described, the present disclosure is not limited to the above embodiment, and various modifications can be made to the embodiment without departing from the scope of the disclosure.

In the above embodiment, the first protrusion 261, the second protrusion 262, and the third protrusion 263 are integrally formed with the detection gear 200. Alternatively, each of the first protrusion 261, the second protrusion 262, and the third protrusion 263 may be a different component separately formed from the detection gear 200.

In this case, the detection gear may have a cam. Specifically, the detection gear may have such a configuration that the detection gear moves in accordance with rotation of the coupling to transit between a first state where the cam and the protrusion contact each other and a second state where the cam and the protrusion are separated from each other, and the protrusions are moved by the transition of the detection gear between the first state and the second state. For example, the protrusion may linearly move. The protrusion may have any configuration as long as the protrusion can move the main body lever 7A. Further, at least one of the second protrusion and the third protrusion may be omitted from the developing cartridge.

Figure 15A:
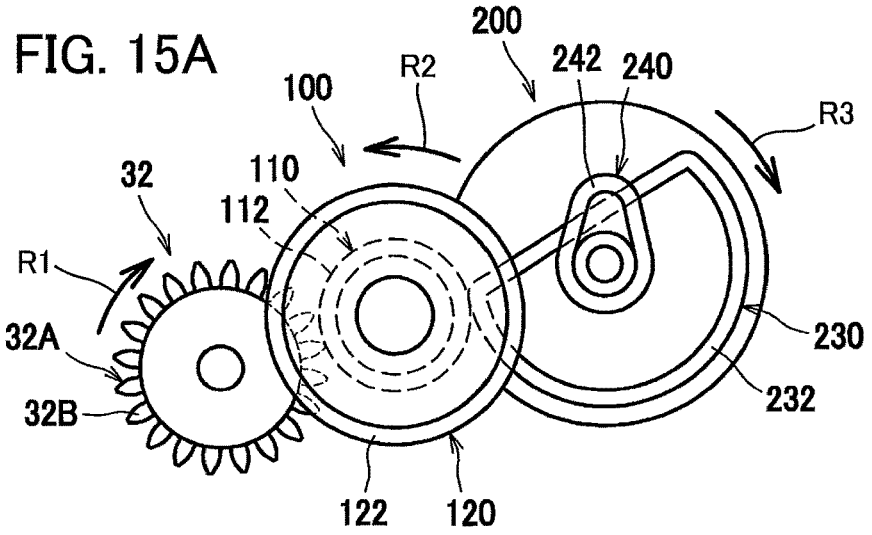
FIG. 15A is a view illustrating a gear portion of a developing cartridge according to a modified example of the embodiment.
Figure 15B:
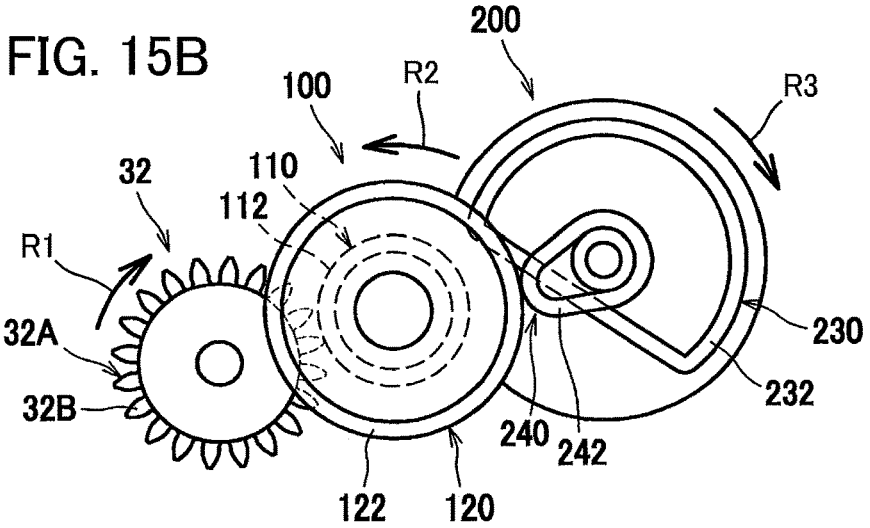
FIG. 15B is a view illustrating the gear portion of the developing cartridge according to the modified example of the embodiment.
Figure 15C:
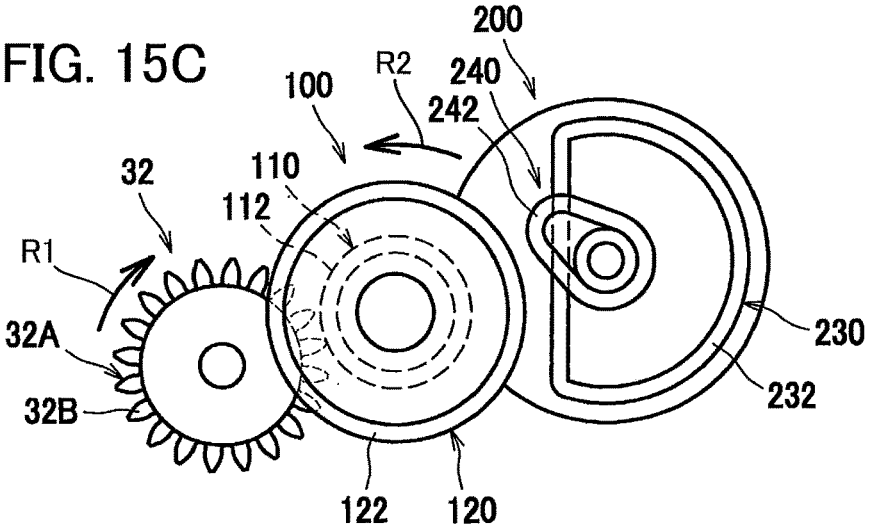
FIG. 15C is a view illustrating a gear portion of the developing cartridge according to the modified example of the embodiment.

In the above embodiment, the gear portions 110, 120, 230, and 240 include the plurality of gear teeth 111, 121, 231, and 241, respectively. However, as illustrated in FIGS. 15A to 15C, the gear portions 110, 120, 230, and 240 may include friction members 112, 122, 232, and 242, respectively, in place of the gear teeth 111, 121, 231, and 241. The friction members 112, 122, 232, and 242 are each made of rubber, for example.

FIG. 15A illustrates a case where the detection gear 200 is positioned at the initial position. In this case, the friction member 232 of the third gear portion 230 is in engagement with the friction member 112 of the first gear portion 110 and the friction member 242 of the fourth gear portion 240 is not in engagement with the friction member 122 of the second gear portion 120. FIG. 15B illustrates a case where the detection gear 200 is positioned at the second rotational position. In this case, the friction member 232 is not in engagement with the friction member 112 and the friction member 242 is in engagement with the friction member 122. FIG. 15C illustrates a case where the detection gear 200 is positioned at the final position. In this case, the friction member 232 is not in engagement with the friction member 112 and the friction member 242 is not in engagement with the friction member 122.

In FIGS. 15A to 15C, all the gear portions include the friction member. Alternatively, at least one of the first gear portion, the second gear portion, the third gear portion, and the fourth gear portion may include the friction member. Further, the gear portion 32A of the second agitator gear 32 may include a friction member in place of the gear teeth 32B.

In the above embodiment, the first gear portion 110 is provided over the entire circumferential periphery of the idle gear 100, and the third gear portion 230 is provided only at a portion of the circumferential periphery of the detection gear 200. However, the configurations of the first gear portion 110 and the third gear portion 230 are not limited to the above configurations. For example, the first gear portion 110 may be provided over only a portion of the circumferential periphery of the idle gear 100, and the third gear portion 230 may be provided over the entire circumferential periphery of the detection gear 200. The same is true with respect to the second gear portion 120 and the fourth gear portion 240.

In the above embodiment, the detection lever 300 is swingably supported by the second gear cover 31. Alternatively, the detection lever 300 may be swingably supported by the casing 11. Further, the detection lever 300 may be swingably supported by both the casing 11 and the second gear cover 31. For example, the casing 11 includes a second lever shaft extending in the first direction and positioned at the outer surface 11E. In this example, the second lever shaft is inserted into the hole 310 of the tubular portion 315 from one side in the axial direction, and the lever shaft 31B of the second gear cover 31 is inserted into the hole 310 from the other side in the axial direction, thereby enabling the detection lever 300 to swingably move about the lever shaft 31B and the second lever shaft.

In the above embodiment, the detection lever 300 is swingably movable about the fourth axis 300X. Alternatively, the detection lever 300 may move linearly.

In the above embodiment, the agitator shaft 14A is employed as an example of the shaft. However, the shaft may be, in place of the agitator shaft 14A, a shaft which is only for transmitting drive force from the one side to the other side of the casing 11 in the first direction.

In the above embodiment, the idle gear 100 is employed as an example of the first gear. However, the first gear may be a gear rotatable together with the agitator 14. That is, the developing cartridge may have a configuration that does not include the second agitator gear 32. Further, the coupling, the first gear, the second gear, and the lever may be positioned at the same side of the casing in the first direction.

In the above embodiment, the torsion spring 400 is employed as an example of the first urging member. However, the first urging member may be a spring other than the torsion spring. Further, the first urging member may be a member other than a spring as long as the member has elasticity. For example, the first urging member may be rubber. The same is true with respect to the second urging member. The developing cartridge may have a configuration that does not include the second urging member.

In the first embodiment, the initial position is taken as an example of the first rotational position. Alternatively, the first rotational position may be a position other than the initial position. For example, the first rotational position may be a position between the initial position and the second rotational position in the above embodiment. Further, the final position is taken as an example of the third rotational position. However, the third rotational position may be a position other than the final position. For example, the third rotational position may be a position between the second rotational position and the final position in the above embodiment.

In the above embodiment, the developing cartridge 10 is separately formed from the photosensitive cartridge 5. Alternatively, the developing cartridge 10 may be integrally formed with the photosensitive cartridge 5.

In the above embodiment, the monochrome laser printer 1 is taken as an example of the image forming apparatus. However, the image forming apparatus may be a color image forming apparatus, an apparatus that performs exposure using an LED, a copier, or a multifunction machine.

The elements in the embodiment and modifications thereof may be arbitrarily combined in the implementation.

What is claimed is:

1. A developing cartridge comprising:

a casing configured to accommodate therein developing agent;

a lever movable relative to the casing between a first position and a second position, the lever being positioned at an outer surface of the casing;

a first urging member configured to urge the lever toward the first position;

a first gear rotatable about a first axis extending in a first direction, the first gear being positioned at the outer surface of the casing, the first gear including:

a first gear portion having an addendum circle; and a second gear portion positioned at a position different from a position of the first gear portion in the first direction, the second gear portion having an addendum circle greater than the addendum circle of the first gear portion;

a second gear rotatable about a second axis extending in the first direction, the second gear being positioned at the outer surface of the casing, the second gear including:

a third gear portion engageable with the first gear portion, the third gear portion having an addendum circle; and a fourth gear portion engageable with the second gear portion, the fourth gear portion being positioned at a position different from a position of the third gear portion in the first direction, the fourth gear portion having an addendum circle smaller than the addendum circle of the third gear portion; and a first protrusion rotatable together with the second gear, the first protrusion contacting the lever to move the lever from the first position to the second position against urging force of the first urging member in a case where the second gear rotates in a state where the second gear portion is in engagement with the fourth gear portion.

2. The developing cartridge according to claim 1, wherein the second gear is rotatable from a first rotational position to a second rotational position and further from the second rotational position to a third rotational position, wherein, in a case where the second gear rotates from the first rotational position to the second rotational position, the first gear portion engages with the third gear portion, and wherein, in a case where the second gear rotates from the second rotational position to the third rotational position, the second gear portion engages with the fourth gear portion.

3. The developing cartridge according to claim 2, further comprising a second protrusion rotatable together with the second gear, the second protrusion being positioned away from the first protrusion in a rotational direction of the second gear, wherein, in a case where the second gear rotates from the first rotational position to the second rotational position, the second protrusion contacts the lever to move the lever from the first position to the second position against the urging force of the first urging member, and then the contact between the second protrusion and the lever is released and the first urging member urges the lever to move the lever from the second position to the first position.

4. The developing cartridge according to claim 3, further comprising a third protrusion rotatable together with the second gear, the third protrusion being positioned away from the first protrusion and the second protrusion in the rotational direction of the second gear;

wherein, in a case where the second gear is positioned at the first rotational position, the third protrusion is in contact with the lever to position the lever at the second position against the urging force of the first urging member, and wherein, in a case where the second gear rotates from the first rotational position to the second rotational position, the contact between the third protrusion and the lever is released and the first urging member urges the lever to move the lever from the second position to the first position, and then the second protrusion contacts the lever to move the lever from the first position to the second position against the urging force of the first urging member.

5. The developing cartridge according to any of claim 2, further comprising a second urging member configured to hold the second gear at the third rotational position.

6. The developing cartridge according to claim 5, wherein the second urging member is a spring.

7. The developing cartridge according to claim 6, further comprising a cover covering at least a portion of the lever, the cover being positioned at the outer surface of the casing, wherein the spring is a torsion spring, the torsion spring including:

a coil portion;

a first arm extending from one end of the coil portion; and a second arm extending from another end of the coil portion, wherein the first arm is fixed to one of the casing and the cover, and wherein the second arm is configured to contact the second gear.

8. The developing cartridge according to claim 1, further comprising:

an agitator configured to agitate the developing agent and rotatable about a third axis extending in the first direction, the agitator including a shaft extending in the first direction; and an agitator gear mounted to the shaft and rotatable together with the agitator, the agitator gear being in engagement with the first gear.

9. The developing cartridge according to claim 1, wherein the third gear portion is positioned at a portion of a circumferential periphery of the second gear and the fourth gear portion is positioned at a portion of the circumferential periphery of the second gear, and wherein the fourth gear portion is positioned at a position different from a position of the third gear portion in a rotational direction of the second gear.

10. The developing cartridge according to claim 9, wherein the third gear portion has a length in the rotational direction greater than a length of the fourth gear portion in the rotational direction.

11. The developing cartridge according to claim 1, wherein the lever is swingably movable about a fourth axis extending in the first direction.

12. The developing cartridge according to claim 1, further comprising a cover covering at least a portion of the lever, the cover being positioned at the outer surface of the casing, wherein the lever is supported by one of the casing and the cover.

13. The developing cartridge according to claim 12, wherein the cover includes a lever shaft extending in the first direction, wherein the lever has a hole into which the lever shaft is inserted, and wherein the lever is swingably movable about the lever shaft.

14. The developing cartridge according to claim 12, wherein the cover has an opening, and wherein at least a portion of the lever is exposed through the opening.

15. The developing cartridge according to claim 1, further comprising a developing roller rotatable about a fifth axis extending in the first direction.

16. The developing cartridge according to claim 1, wherein the first gear portion includes a plurality of gear teeth.

17. The developing cartridge according to claim 1, wherein the first gear portion includes a friction member.

18. The developing cartridge according to claim 17, wherein the friction member is a rubber.

19. The developing cartridge according to claim 1, wherein the second gear portion includes a plurality of gear teeth.

20. The developing cartridge according to claim 1, wherein the second gear portion includes a friction member.

21. The developing cartridge according to claim 20, wherein the friction member is a rubber.

22. The developing cartridge according to claim 1, wherein the third gear portion includes a plurality of gear teeth.

23. The developing cartridge according to claim 1, wherein the third gear portion includes a friction member.

24. The developing cartridge according to claim 23, wherein the friction member is a rubber.

25. The developing cartridge according to claim 1, wherein the fourth gear portion includes a plurality of gear teeth.

26. The developing cartridge according to claim 1, wherein the fourth gear portion includes a friction member.

27. The developing cartridge according to claim 26, wherein the friction member is a rubber.

28. The developing cartridge according to claim 1, wherein, in a state where the developing cartridge is attached to an image forming apparatus, the lever is in contact with a portion of the image forming apparatus in a case where the lever is positioned at the second position, while the lever is out of contact with the portion of the image forming apparatus in a case where the lever is positioned at the first position.

29. The developing cartridge according to claim 1, wherein the first urging member is a spring.

30. The developing cartridge according to claim 29, further comprising a cover covering at least a portion of the lever, the cover being positioned at the outer surface of the casing, wherein the spring is a torsion spring, the torsion spring including:

a coil portion;

a first arm extending from one end of the coil portion; and a second arm extending from another end of the coil portion, wherein the first arm is fixed to one of the casing and the cover, and wherein the second arm is in contact with the lever.

* * * * *